US012686517B1

(12) United States Patent
Milz et al.

(10) Patent No.: US 12,686,517 B1
(45) Date of Patent: Jul. 21, 2026

(54) MODULAR SEALING APPARATUS

(71) Applicant: Contemplate LLC, Fairfield, CA (US)

(72) Inventors: Christoph Milz, Fairfield, CA (US); Uwe Schaumann, Oberderdingen (DE)

(73) Assignee: CONTEMPLATE LLC, Fairfield, CA (US)

( * ) Notice: Subject to any disclaimer, the term of this patent is extended or adjusted under 35 U.S.C. 154(b) by 0 days.

(21) Appl. No.: 19/033,412

(22) Filed: Jan. 21, 2025

(51) Int. Cl.
*B65B 51/10* (2006.01)
*B65B 31/02* (2006.01)
*B65B 57/00* (2006.01)

(52) U.S. Cl.
CPC ..... *B65B 51/10* (2013.01); *B65B 31/02* (2013.01); *B65B 57/00* (2013.01); *B65B 2051/105* (2013.01)

(58) Field of Classification Search
CPC ... B65B 2051/105; B65B 57/00; B65B 31/02; B65B 51/10
USPC ..... 53/405
See application file for complete search history.

(56) References Cited

U.S. PATENT DOCUMENTS 5,239,808 A * 8/1993 Wells ..... B65B 31/024 53/512
11,104,502 B2 8/2021 Espinosa
12,016,486 B2 6/2024 Cohen
2012/0060447 A1* 3/2012 Liu ..... B29C 66/861 53/370.7
2014/0196405 A1* 7/2014 Owens ..... B29C 66/43121 53/396

FOREIGN PATENT DOCUMENTS

CN 1639010 A 7/2005

* cited by examiner

*Primary Examiner* — Veronica Martin
*Assistant Examiner* — Mary C Hibbert-Copeland
(74) *Attorney, Agent, or Firm* — EVERGREEN VALLEY LAW GROUP; Kanika Radhakrishnan

(57) ABSTRACT

Embodiments of the present disclosure provide a modular sealing apparatus for a vacuum packaging machine. The modular sealing apparatus includes a cap module including a central portion. The central portion locates thereupon a heating wire. The heating wire is configured to heat up when supplied with electrical power through an electrical power unit. The modular sealing apparatus further includes an actuation box, the cap module detachably coupled to the actuation box. The actuation box is located under the cap module. Furthermore, the actuation box includes an electrical drive unit configured to cause the cap module to move upwards and against a counterpart, by activating an actuation member. The modular sealing apparatus also includes an interface module coupled to the actuation box. The interface module is configured to detachably fasten the actuation box to the vacuum packaging machine, and enable supply of the electrical power to the actuation box.

25 Claims, 20 Drawing Sheets

MODULAR SEALING APPARATUS

TECHNICAL FIELD

The present disclosure relates to sealing apparatus used in conjunction with vacuum packaging machines for sealing items in plastic bags, and more particularly relates to sealing apparatus that are compatible with several types of vacuum packaging machines used in several industrial, commercial, and domestic applications.

BACKGROUND

A vacuum packaging machine is a device used to create a vacuum environment within a sealed chamber. This is achieved by removing air or other gases from the chamber, resulting in a near-zero pressure environment. Vacuum chamber machines are commonly used in various industries, including food packaging, medical device manufacturing, and laboratory research, for sealing and preserving products. A typical sealing process includes the following steps: (1) a product to be sealed is placed inside a heat-scalable pouch or bag, (2) the pouch or the bag containing the product is then placed inside a vacuum chamber and an open end of the pouch or the bag is located in between two jaws (one movable seal bar and another a counterpart), where one of the sealing bars has a heated wire assembled thereupon, (3) the vacuum chamber is sealed, creating an airtight environment, (4) a vacuum pump is activated, which removes air or other gases from the vacuum chamber, reducing the pressure inside, (5) as the vacuum is created, the pressure difference between the inside and outside of the pouch causes the pouch to collapse, at the same time, electric current is applied to the heating wire causing the heating wire to heat up and melt the plastic layers at the open end of the pouch and creating a hermetic seal.

The existing standard is that an operator has to set a time, for instance, between 1.5-3.0+ seconds, in steps of 1/10th of a second. The timer indirectly controls the temperature by way of the amount of electrical current supplied to the heating wire. This means the temperature setting is unknown and guesswork. However, the heating wire temperature is the most important of three parameters (time, temperature, and pressure) and should be set to a specific temperature based on the chemical composition of the film that is being used as bag material. When the operator sets the time for too long or too short, the seal will not be solid and break. In case of too much heat, which is a common issue, a protective non-stick Teflon tape on the seal wire would burn through and need to be replaced. Furthermore, the pressure between the two sealing bars is linked to the air pressure in the chamber. In the case of operating at a low vacuum level of less than 40% or 600 mBar, the pressure between the two sealing bars starts to become insufficient for a proper seal. In use with liquids, there is a risk of liquid entering a membrane component of the seal system and increased contamination of vacuum pump oil, which leads to malfunctioning of the vacuum packaging machine and hygiene problems.

Furthermore, the sealing bars are awkwardly mounted and require tools that are not commonly available in this kind of operation, which leads to a lack of cleaning by operators. In addition, any malfunction normally requires a costly onsite visit of a trained technician. Also, the non-modular assembly of the sealing bars leads to time-consuming steps of disassembly and reassembly. High maintenance and repair costs lead to decisions to omit repair and shorten the lifetime of the overall device. Furthermore, components of the sealing subsystem are non-standard and are not compatible with machines of different sizes or makes. Therefore, there is a need in the art for a modular sealing apparatus that overcomes at least some of the limitations and deficiencies presented in the aforementioned discussion.

SUMMARY

An object of the present disclosure is to convert a sealing subsystem of a vacuum chamber machine into a modular sealing apparatus that includes defined interfaces to fit with a wide range of existing vacuum packaging machine models from a variety of manufacturers.

Another object of the present disclosure is to provide lower-cost components in the modular sealing apparatus, simplicity in construction, tool-free assembly and maintenance, hygienic design, precise control over key parameters (such as temperature, contact force/pressure, and melding time) enabling prolonged lifetime. The modular design for the sealing apparatus would also open doors for other modifications and modularity of the entire vacuum packaging machine.

Another object of the present disclosure is to design the modular sealing apparatus in a way that requires manufacturers of vacuum packaging machines to make only minor modifications to existing models for integrating the modular sealing apparatus.

Embodiments of the present disclosure provide a modular sealing apparatus for a vacuum packaging machine. The modular sealing apparatus includes a cap module including a central portion. The central portion locates thereupon a heating wire and a protective film configured to cover the heating wire. In several embodiments, where the cap module may include materials capable of conducting electricity or otherwise for general safety purposes, a layer of insulating material may also be provided between at least the central portion and the heating wire. The heating wire is connected to an electrical power unit and is configured to heat up when supplied with electrical power through the electrical power unit. The modular sealing apparatus further includes an actuation box, the cap module detachably coupled to the actuation box. The actuation box is located below the cap module. Furthermore, the actuation box includes an electrical drive unit. In use, the electrical drive unit is configured to cause the cap module to move upwards and against a counterpart attached to the vacuum packaging machine, by activating an actuation member of the electrical drive unit. The modular sealing apparatus also includes an interface module detachably coupled to the actuation box. The interface module is configured to detachably fasten the actuation box to the vacuum packaging machine, and enable supply of the electrical power to the actuation box from the vacuum packaging machine.

According to another aspect of the present disclosure, there is provided a modular sealing apparatus for a vacuum packaging machine. The modular sealing apparatus includes a cap module including a central portion. The central portion locates thereupon a heating wire. The heating wire is connected to an electrical power unit and is configured to heat up when supplied with electrical power through the electrical power unit. The modular sealing apparatus further includes an actuation box. The cap module is detachably coupled to the actuation box. The actuation box is located below the cap module. The actuation box includes an electrical drive unit. Furthermore, in use, the electrical drive unit is configured to cause the cap module to move upwards and against a counterpart attached to the vacuum packaging machine, by activating an actuation member of the electrical drive unit. The modular sealing apparatus also includes an interface module coupled to the actuation box. The interface module is configured to detachably fasten the actuation box to the vacuum packaging machine, and enable supply of the electrical power to the actuation box from the vacuum packaging machine. Furthermore, electrical power unit is configured to be supplied with the electrical power, from the actuation box, through a first contact member. The cap module further includes a sensor module including one or more sensors configured to sense one or more of at least one temperature value in an upper portion of the cap module, a contact force between the cap module and the counterpart, and a pressure between the cap module and the counterpart. The sensor module is configured to be supplied with the electrical power, from the actuation box, through at least one of the first contact member or a second contact member. Also, at least one data connection connects the sensor module and the actuation box. The at least one data connection is configured to transmit sensor data from the sensor module to the actuation box.

According to another aspect of the present disclosure, there is provided a vacuum packaging machine. The vacuum packaging machine includes a vacuum chamber defined by a lid member and a cavity in a lower compartment. At least one modular sealing apparatus is detachably coupled to at least one internal wall of the vacuum chamber. The at least one modular sealing apparatus includes a cap module including a central portion. The central portion locates thereupon a heating wire, the heating wire is connected to an electrical power unit and is configured to heat up when supplied with electrical power through the electrical power unit. The at least one modular sealing apparatus further includes an actuation box, the cap module detachably coupled to the actuation box. The actuation box is located below the cap module. The actuation box includes an electrical drive unit. In use, the electrical drive unit is configured to cause the cap module to move upwards and against a counterpart attached to the roof of the lid member, by activating an actuation member of the electrical drive unit. The at least one modular sealing apparatus also includes an interface module coupled to the actuation box. The interface module is configured to detachably fasten the actuation box to the vacuum packaging machine, and enable supply of the electrical power to the actuation box from the vacuum packaging machine.

According to another aspect of the present disclosure, there is provided a method for operating a vacuum packaging machine. The vacuum packaging machine includes a vacuum chamber defined by a lid member and a cavity in a lower compartment. At least one modular sealing apparatus is detachably coupled to at least one internal wall of the vacuum chamber. The method is performed by a machine control architecture of the vacuum packaging machine or a controller of the at least one modular sealing apparatus. The method includes receiving a selection of melding time. Furthermore, the method includes supplying electrical power to one or more electrical drive units of the at least one modular scaling apparatus to push a cap module of the at least one modular sealing apparatus towards a counterpart attached to the lid member. The method further includes supplying the electrical power to a heating wire of the at least one modular sealing apparatus. The method further includes receiving a value of time elapsed from an internal clock. Furthermore, the method includes retracting the cap module by activating the one or more electrical drive units, when the received value of the time elapsed equals or exceeds the received selection of melding time. The method also includes stopping the supply of the electrical power to the heating wire.

According to another aspect of the present disclosure, there is provided a method for operating a vacuum packaging machine. The vacuum packaging machine includes a vacuum chamber defined by a lid member and a cavity in a lower compartment. At least one modular sealing apparatus is detachably coupled to at least one internal wall of the vacuum chamber. The method is performed by a machine control architecture of the vacuum packaging machine or a controller of the at least one modular sealing apparatus. The method includes receiving an input indicating the material of a packet to be packaged. Furthermore, the method includes determining a desired value of at least one melding parameter, based on the material of the packet. The method further includes supplying electrical power to one or more electrical drive units of the at least one modular sealing apparatus to push a cap module of the at least one modular sealing apparatus towards a counterpart attached to the lid member. The method further includes receiving at least one value corresponding to at least one of a contact force or a pressure between the cap module and the counterpart, from a sensor module of the at least one modular sealing apparatus. The method further includes supplying the electrical power to a heating wire of the at least one modular scaling apparatus, after at least one of a desired contact force or a desired pressure has been achieved. Furthermore, the method includes receiving a value of the at least one melding parameter, from at least one of an internal clock or the sensor module of the at least one modular scaling apparatus. Furthermore, the method includes retracting the cap module by activating the one or more electrical drive units, when the received value of the at least one melding parameter is identical or equivalent to the determined desired value of the at least one melding parameter. The method also includes stopping the supply of the electrical power to the heating wire.

In the context of the specification, the phrase "deformable material" refers to material that is capable of undergoing temporary and reversible deformation when applied with a predetermined amount of force. Some of the examples of deformable materials include, but are not limited to, springs and elastomeric materials.

BRIEF DESCRIPTION OF THE DRAWINGS

The following detailed description of illustrative embodiments is better understood when read in conjunction with the appended drawings. To illustrate the present disclosure, exemplary constructions of the disclosure are shown in the drawings. However, the present disclosure is not limited to a specific device, or a tool and instrumentalities disclosed herein. Moreover, those in the art will understand that the drawings are not to scale. Wherever possible, like elements have been indicated by identical numbers.

Figure 1:
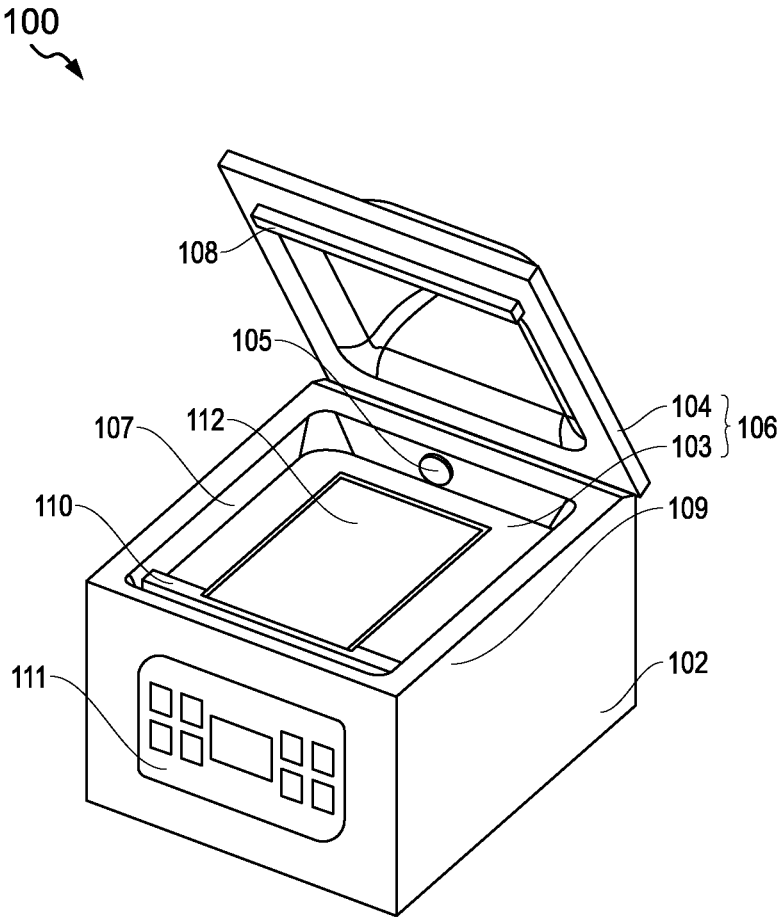
FIG. 1 (PRIOR ART)
FIG. 1 illustrates a perspective view of a conventional vacuum packaging machine.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification does not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Various example embodiments provide modular scaling apparatus for a vacuum chamber machine. The modular sealing apparatus includes a cap module, an actuation box, the cap module detachably coupled to the actuation box, and an interface module detachably coupled to the actuation box. The cap module includes a central portion. A heating wire is located upon the central portion. Furthermore, a protective film may be provided to cover the heating wire. In that regard, the cap module may further include at least one end connecting portion provided on at least one respective end of the central portion. The at least one end connecting portion is configured to fasten the heating wire to the central portion. The heating wire is connected to an electrical power unit in the cap module and is configured to heat up when supplied with electrical power through the electrical power unit. The electrical power unit may be configured to enable the supply of electrical power directly from the vacuum packaging machine to the heating wire.

Alternately, the electrical power unit may be configured to be supplied with the electrical power from the actuation box, through a first contact member. To ensure the hygiene and longevity of components of the modular sealing apparatus, the first contact member may be encapsulated by a first upper sleeve and a first lower sleeve. One of the first upper sleeve and the first lower sleeve may socket the other. Furthermore, a first sealing ring may be provided between the first upper sleeve and the first lower sleeve. In that regard, the electrical power unit may include a conductor spring strip including a deformable portion. The conductor spring strip may be configured to be in contact with the first contact member and supply electrical power to the heating wire through a contact port when the modular scaling apparatus is in use.

The cap module may further include a sensor module including one or more sensors configured to sense at least one temperature value in an upper portion of the cap module. The one or more sensors may further be configured to sense at least one of a contact force or a pressure between the cap module and the counterpart. In several embodiments, at least one data connection connects the sensor module and the actuation box. The at least one data connection is configured to transmit sensor data from the sensor module to the actuation box. In that regard, the at least one data connection may be a hardware line or a wireless connection for example, through Bluetooth, ZigBee, a radio-frequency connection, etc. The sensor module may be configured to be supplied with the electrical power, from the actuation box, through at least one of the first contact member or a second contact member. The second contact member may be encapsulated by a second upper sleeve and a second lower sleeve, where one of the second upper sleeve and the second lower sleeve sockets the other. Furthermore, a second sealing ring may be provided between the second upper sleeve and the second lower sleeve. Furthermore, a wire or a data line may be connected between the sensor module and the actuation box to transfer sensor data from the one or more sensors to a machine control architecture of the vacuum packaging machine or a controller located within the actuation box. In several alternate embodiments, the sensor data may be transmitted wirelessly between the cap module and the actuation box, such as through Bluetooth or ZigBee protocols.

The actuation box is located below the cap module. The first contact member and the second contact member may therefore be located in an upper portion of the actuation box. The actuation box includes an electrical drive unit. In use the electrical drive unit is configured to cause the cap module to move upwards and against a counterpart attached to the vacuum chamber machine. The electrical drive unit moves the cap module by activating an actuation member of the electrical drive unit. The electrical drive unit may include an actuator selected from a group consisting of a linear actuator, a rotary actuator coupled to a transmission configured to convert the rotary motion of the rotary actuator into a linear motion of at least the actuation member, a Shape-Memory-Alloy (SMA), a thermal actuator, and combinations thereof. In one implementation of the modular scaling apparatus, in use, the actuation box and the counterpart are configured to remain stationary and the cap module is configured to move upwards and downwards relative to the actuation box and the counterpart, by activating the actuation member removably fastened to the cap module. In that regard, the cap module may further include at least one support cavity in a lower portion of the cap module. The at least one support cavity may be configured to receive therewithin the actuation member. The actuation member, in that regard, may be coupled to the cap module using a snap-fit arrangement or a friction-based fastening for convenient removal and reassembly of the cap module from above the actuation box.

In an alternate implementation of the modular sealing apparatus, in use, the counterpart is configured to be stationary, and the actuation box and the cap module arc configured to together move upwards and downwards relative to the counterpart, by activating the actuation member in contact with a floor of a vacuum chamber of the vacuum packaging machine. In that regard, the at least one support cavity may be configured to receive therewithin at least one upper support member. The at least one upper support member may be coupled to the cap module using a snap-fit arrangement or a friction-based fastening for convenient removal and reassembly of the cap module from above the actuation box.

For ensuring hygiene, a portion of the actuation member protruding outside the actuation box may be encapsulated by an actuation member sleeve and an actuation member sealing ring. For ensuring safety, a predetermined gap may be provided between the contact port and an open end of the conductor spring strip, such that, the open end of the conductor spring strip may be configured to traverse the predetermined gap in response to a predetermined pressure exerted by the cap module onto the counterpart. For enhancing functionality, the cap module may include a modified central portion wherein a modified upper surface of at least the modified central portion is bent upwards forming an upward convex geometry. In that regard, the cap module may further include a modified heating wire and a modified protective film conforming with the upward convex geometry of the modified central portion.

Furthermore, at least the modified central portion may be made from a deformable material, and the actuation box may include two or more electrical drive units and two or more respective actuation members. In use, the two or more electrical drive units are configured to be provided with disparate amounts of electrical power resulting in disparate magnitudes of linear motion of the two or more respective actuation members. When combined with the ability of the modified central portion to be deformable, the two or more actuation members are configured to modify a geometry of the cap module to achieve disparate predetermined geometries of space between the counterpart and the cap module, in conformance with disparate respective predetermined geometries of disparate respective packets to be sealed.

In addition, the one or more sensors of the sensor module may also sense at least one of a contact force or a pressure between the cap module and the counterpart. The counterpart may include one or more counterpart sensors connected to the sensor module. The one or more counterpart sensors may be configured to sense at least one temperature value in a lower portion of the counterpart. The one or more counterpart sensors may also sense the at least one of the contact force or the pressure between the cap module and the counterpart. In that regard, the one or more counterpart sensors may be connected to the actuation box, through a counterpart sensor data line. In several implementations of the modular scaling apparatus, the actuation box may further include a controller, where the controller would be configured to control one or more of an activation of the actuation member, a temperature in a melding zone, and a time period of the melding process.

The interface module is configured to detachably fasten the actuation box to the vacuum packaging machine and enable the supply of the electrical power from the vacuum packaging machine to the actuation box. In that regard, the interface module may include at least one dock configured to be fastened to at least one respective internal wall of the vacuum chamber, and at least one channel configured to receive therein at least one respective protrusion provided with the actuation box, to detachably couple the actuation box to the interface module. The modular sealing apparatus may further include an installation box including a plurality of first terminal pins for at least one of an electrical power connection or a data connection with a plurality of respective second terminal pins of the actuation box. The installation box may be configured to be detachably fastened to the internal wall of the vacuum chamber of the vacuum packaging machine. The installation box may be configured to be detachably fastened to an external wall through one or more magnets. The interface module in such a scenario may include a plurality of double-sided receptacles configured to receive therewithin, the plurality of first terminal pins and the plurality of respective second terminal pins, and enable electrical conduction between the plurality of first terminal pins and the plurality of respective second terminal pins.

The plurality of first terminal pins and the plurality of respective second terminal pins may be configured to be received within the plurality of double-sided receptacles without the use of additional assembly tools. Examples of additional assembly tools may include manual drivers, manual spanners, electrically powered wrenches and drivers, and pneumatically powered wrenches and drivers. Furthermore, at least one actuation box shoe may be provided in a lower portion of the actuation box and at least one interface module shoe may be provided in a lower portion of the interface module. One or both of the at least one actuation box shoe and the at least one interface module shoe may include a quick-release fastening arrangement to removably fasten the actuation box and the interface module, respectively, to a floor of a vacuum chamber of the vacuum packaging machine.

According to another aspect of the present disclosure, there is provided a vacuum packaging machine. The vacuum packaging machine includes a vacuum chamber defined by a lid member and a cavity in a lower compartment. At least one modular sealing apparatus is detachably coupled to at least one internal wall of the vacuum chamber. The at least one modular sealing apparatus includes a cap module including a central portion. The central portion locates thereupon a heating wire, the heating wire is connected to an electrical power unit and is configured to heat up when supplied with electrical power through the electrical power unit. The at least one modular sealing apparatus further includes an actuation box, the cap module detachably coupled to the actuation box. The actuation box is located below the cap module. The actuation box includes an electrical drive unit.

In use, the electrical drive unit is configured to cause the cap module to move upwards and against a counterpart attached to a roof of the lid member, by activating an actuation member of the electrical drive unit. The at least one modular sealing apparatus also includes an interface module coupled to the actuation box. The interface module is configured to detachably fasten the actuation box to the vacuum packaging machine, and enable supply of the electrical power to the actuation box from the vacuum packaging machine. Furthermore, a plurality of counterpart protrusions may be provided at a bottom surface of the counterpart. The plurality of counterpart protrusions may be made from a deformable material and may be provided with a weak adhesive to removably attach a packet, when the vacuum packaging machine is in use According to another aspect of the present disclosure, there is provided a method for operating a vacuum packaging machine using an open loop control strategy. The vacuum packaging machine includes a vacuum chamber defined by a lid member and a cavity in a lower compartment. At least one modular sealing apparatus is detachably coupled to at least one internal wall of the vacuum chamber. The open loop control method is performed by a machine control architecture of the vacuum packaging machine or a controller of the at least one modular sealing apparatus. The open loop control method includes receiving a selection of melding time. Furthermore, the open loop control method includes supplying electrical power to one or more electrical drive units of the at least one modular sealing apparatus to push a cap module of the at least one modular sealing apparatus towards a counterpart attached to the lid member. The open loop control method further includes supplying the electrical power to a heating wire of the at least one modular sealing apparatus. The open loop control method further includes receiving a value of time elapsed from an internal clock. Furthermore, the open loop control method includes retracting the cap module by activating the one or more electrical drive units, when the received value of the time elapsed equals or exceeds the received selection of melding time. The open loop control method also includes stopping the supply of the electrical power to the heating wire.

According to another aspect of the present disclosure, there is provided a method for operating a vacuum packaging machine using a dynamic closed loop control strategy. The vacuum packaging machine includes a vacuum chamber defined by a lid member and a cavity in a lower compartment. At least one modular sealing apparatus is detachably coupled to at least one internal wall of the vacuum chamber. The dynamic closed loop control method is performed by a machine control architecture of the vacuum packaging machine or a controller of the at least one modular sealing apparatus. The dynamic closed loop control method includes receiving an input indicating a material of a packet to be packaged. Furthermore, the dynamic closed loop control method includes determining a desired value of at least one melding parameter, based on the material of the packet. The dynamic closed loop control method further includes supplying electrical power to one or more electrical drive units of the at least one modular sealing apparatus to push a cap module of the at least one modular sealing apparatus towards a counterpart attached to the lid member.

The dynamic closed loop control method further includes receiving at least one value corresponding to at least one of a contact force or a pressure between the cap module and the counterpart, from a sensor module of the at least one modular scaling apparatus. The dynamic closed loop control method further includes supplying the electrical power to a heating wire of the at least one modular sealing apparatus, after at least one of a desired contact force or a desired pressure has been achieved. Furthermore, the dynamic closed loop control method includes receiving a value of the at least one melding parameter, from at least one of an internal clock or the sensor module of the at least one modular sealing apparatus. Furthermore, the dynamic closed loop control method includes retracting the cap module by activating the one or more electrical drive units, when the received value of the at least one melding parameter is identical or equivalent to the determined desired value of the at least one melding parameter. The dynamic closed loop control method also includes stopping the supply of the electrical power to the heating wire. The dynamic closed loop control method may also include displaying an error message when the at least one of the desired contact force or the desired pressure has not been achieved or the determined desired value of the at least one melding parameter has not been attained, after a predetermined critical number of attempts or a predetermined critical amount of time.

Various example embodiments of the present disclosure are described hereinafter with reference to FIG. 2A to FIG. 11B.

FIG. 1 illustrates a perspective view of a conventional vacuum packaging machine 100 (hereinafter also referred to as "the machine 100"). The machine 100 includes a lower compartment 102. The lower compartment 102 houses several components and constituents of the machine 100. For example, the lower compartment 102 houses a power supply input (not shown) for receiving electrical power, a vacuum pump and associated conduits and valves (not shown), a machine control unit (not shown) that may include a machine controller (a machine processor and a machine memory unit) configured to control the operation of the machine 100. The lower compartment 102 defines a cavity 103 which along with a lid member 104 forms a vacuum chamber 106. The cavity 103 is located in an upper portion of the lower compartment 102. The vacuum chamber 106 has four internal walls 107, and along one or more of the four internal walls 107, there is provided a heating bar 110. For example, four internal walls of the cavity 103 may constitute as at least partial portions of the four respective internal walls 107. Similarly, the vacuum chamber 106 has four external walls 109. For example, four external walls of the lower compartment 102 may constitute as at least partial portions of the four respective external walls 109 of the vacuum chamber 106.

The lid 104 includes a counterpart 108 in a lower portion of the lid 104. The counterpart 108 is configured to make contact with the heating bar 110 in the vacuum chamber 106 when the lid 104 is closed onto the lower compartment 102. The heating bar 110 includes a heating wire (not shown) thereupon. In some vacuum chamber machines, the heating bar 110 may also incorporate a cutting wire. The cutting wire is used to cut the excess bag material after the sealing process is complete. This can be a convenient feature, especially for automated packaging lines. Furthermore, the heating wire (and the cutting wire) may further be covered with a protective film that may be made from Poly-Tetra-Fluoroethylene (PTFE). The vacuum chamber 106 further includes an exhaust port 105 through which the vacuum pump in the lower compartment draws in air from the vacuum chamber 106 to generate a vacuum in the vacuum chamber 106. The lower compartment 102 may further include a control panel 111 allowing an operator to set operating parameters such as the level of the vacuum to be generated in the vacuum chamber 106, melding/heating time, etc. The machine 100 may further include additional safety features such as emergency stop buttons, safety interlocks, and protective covers.

In use, a packet 112 made up of plastic material is located on the heating bar 110. More specifically, an open end of the packet 112 is located on the heating bar 110. The lid 104 is closed so that the open end of the packet 112 is sandwiched between the heating bar 110 and the counterpart 108. The vacuum pump is operated and air is drawn out of the vacuum chamber 106 through the exhaust port 105, causing the packet to collapse. After a predetermined amount of vacuum is achieved within the vacuum chamber 106, electrical power is supplied to the heating wire located on the heating bar 110. The electrical power is supplied to the heating wire for a predetermined amount of time, causing the heating wire to heat up and fuse the plastic material of the packet 112. A typical temperature range during the heating process would be 100-130° C., a melding time of 1.5-2.5 seconds, and pressure between the heating bar 110 and the counterpart 108 would be 0.1-2 $N/mm^2$.

The fusion of the plastic material near the open-end closes and seals the previously open end. The plastic material may be selected from a group consisting of Polyethylene, High-density Polyethylene (HDPE), Low-density Polyethylene (LDPE), Linear Low-density Polyethylene (LLDPE), Polypropylene (PP), Ethylene Vinyl Acetate (EVA), Polymer blends, biopolymers, etc. The removal of air from the packet 112 impedes the growth of microorganisms in the contents of the packet 112 and prevents oxidation of the contents thereby increasing their shelf-life. The types of items that the machine 100 can be used to vacuum package include meat, cheese, and other dairy products, frozen meals, fruits and vegetables, medical supplies and pharmaceuticals, fragile electronic components such as computer parts and circuit boards, automotive components, clothing, beddings, and scientific samples, chemicals, and instruments, etc.

The main parameters for operating the machine 100 are: temperature, sealing pressure, dwelling time, and bag material. As discussed in the earlier discussion, the existing standard for vacuum packaging machines relies on operators setting a time, typically between 1.5 and 3.0 seconds in 0.1-second increments, to control the sealing process. This time setting indirectly controls the temperature of the heating wire, making precise temperature control difficult and relying heavily on operator guesswork. However, the heating wire temperature is crucial for a successful seal, as it must be tailored to the specific chemical composition of the plastic film used for the bag. Incorrect time settings can result in weak seals that break easily, while excessive heat can damage the non-stick PTFE file on the heating wire, requiring costly replacements. Additionally, the pressure between the heating bar 110 and the counterpart 108 is influenced by the vacuum level in the vacuum chamber 106. The pressure between the heating bar 110 and the counterpart 108 can be insufficient for proper sealing at low vacuum levels (below 40% or 600 mBar). When dealing with liquids, there is a risk of the liquids entering the membrane component of the seal system, leading to malfunctions and hygiene issues.

Furthermore, the heating bar 110 and the counterpart 108 are often awkwardly mounted, requiring specialized tools for cleaning and maintenance, which are often unavailable to operators. More specifically, as shown in FIG. 1, the counterpart 108 is fixed to the lid 104, and the heating bar 110 is located inside the vacuum chamber 106. During operation of the machine 100, the counterpart 108 remains stationary, while the heating bar 110 is displaced upwards by an actuator (not shown) located underneath or inside the vacuum chamber 106. This leads to inadequate cleaning and increases the reliance on costly on-site technician visits for repairs. The non-modular assembly of the heating bar 110 and the counterpart 108 makes disassembly and reassembly time-consuming. High maintenance and repair costs can incentivize operators to forego repairs, shortening the overall lifespan of the machine 100. Furthermore, the non-standard components of the sealing subsystem limit compatibility with machines of different sizes or manufacturers.

Figure 2A:
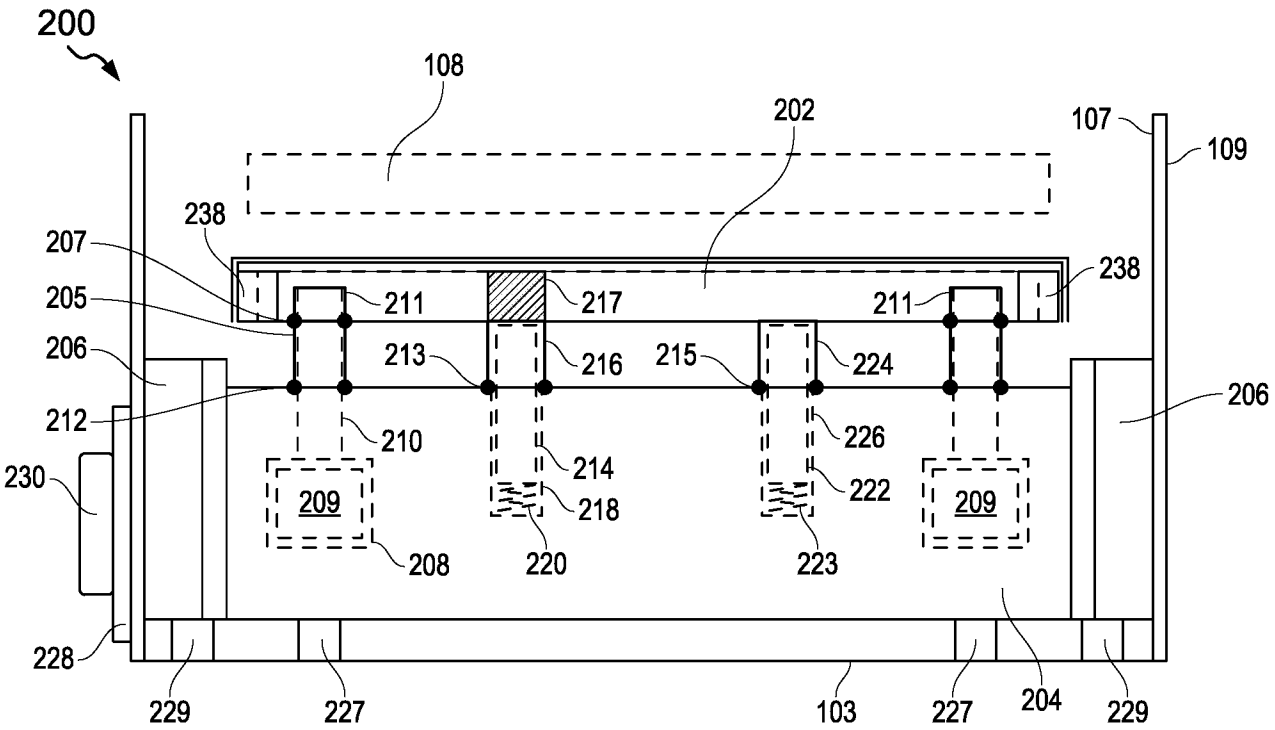
FIG. 2A illustrates a front view of a modular sealing apparatus, in accordance with an embodiment of the present disclosure.
Figure 2B:
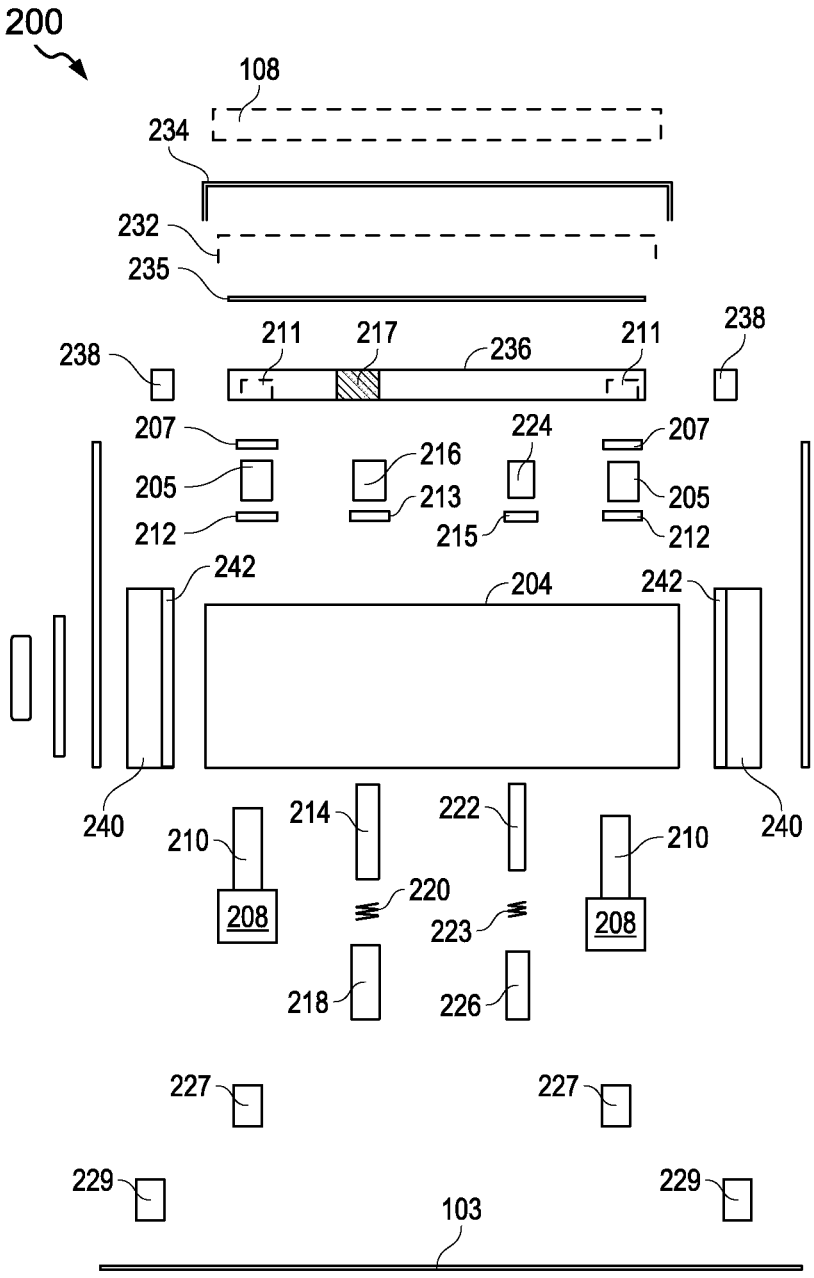
FIG. 2B illustrates an exploded view of the modular sealing apparatus of FIG. 2A.

FIG. 2A illustrates a front view of a modular sealing apparatus 200 (or "the apparatus 200"), in accordance with an embodiment of the present disclosure. FIG. 2B illustrates an exploded view of the modular scaling apparatus of FIG. 2A. The modular sealing apparatus 200 has been designed to replace the heating bar 110 and the actuator from the machine 100. Unlike the heating bar 110 and the actuator in the machine of FIG. 1, the modular sealing apparatus 200 is configured to be removably located in the vacuum chamber 106. The modular sealing apparatus 200 includes a cap module 202, an actuation box 204, and an interface module 206. The actuation box 204 is located below the cap module 202 and is detachably coupled to the cap module 202. Furthermore, the interface module 206 is detachably coupled to the actuation box 204 on at least one lateral surface of the actuation box 204. In FIGS. 2A and 2B, an interface module 206 has been provided at each of a left lateral surface and a right lateral surface of the actuation box 204. Furthermore, the two interface modules 206 detachably connect the actuation box 204 to two internal walls 107 of the vacuum chamber 106 on a left side and a right side of the actuation box 204. Each element of the modular sealing apparatus 200 has been discussed in further detail in the following discussion.

For instance, the cap module 202 includes a central portion 236. The cap module 202 further includes at least one end connection portion 238 provided on at least one respective end of the central portion 236. As depicted in FIGS. 2A and 2B, there have been provided two end connection portions 238, one end connection portion 238 provided on each of a left side end and a right-side end of the central portion 236. A heating wire 232 has been located upon the central portion 236. In several embodiments, the heating wire 232 is fastened to the central portion 236 through one or both of the two end connection portions 238. In several embodiments, where the cap module 202 may include materials capable of conducting electricity or materials capable of being affected by heat or otherwise for general safety purposes, an insulation layer 235 of an insulating material may be provided between at least the central portion 236 and the heating wire 232. The insulation layer 235 may provide at least one of a thermal insulation or an electrical insulation from the heating wire 232.

Furthermore, in several embodiments, the heating wire 232 has been provided with a protective film 234 located upon the heating wire 234. The protective film 234 is configured to protect the heating wire 232 from environmental elements such as oxygen, dust, moisture, etc., and from wear and tear during the usage of the modular scaling apparatus 200 in conjunction with the machine 100. In several embodiments, the protective film 234 may be made up of PTFE. Moreover, the heating wire 232 is connected to an electric power supply unit 217 and is configured to heat up when supplied with electrical power through electrical power unit 217. In several embodiments, the electrical power unit 217 may be located in the central portion 236. In several alternate embodiments, the electrical power unit 217 may be located in the at least one end connection portion 238. In several embodiments, the electrical power unit 217 may draw the electrical power directly from the machine 100 and supply the electrical power to the heating wire 232. In several alternate embodiments, the electrical power unit 217 may receive the electrical power through the actuation box 204 as will be discussed later in the discussion (See FIGS. 5A to 6C).

The actuation box 204 includes an electrical drive unit 208. FIGS. 2A and 2B illustrate the actuation box 204 including two electrical drive units 208 one on each of a left side and a right side of the actuation box 204. Furthermore, the electrical drive unit 208 includes an actuator 209 and an actuation member 210 coupled to the actuator 209. In several embodiments, the actuator 209 may be a linear motor (for example, a linear electromagnetic motor). In several embodiments, the actuator 209 may be a rotary actuator coupled to a transmission configured to convert the rotary motion of the rotary actuator into linear motion of at least the actuation member 210. For example, the transmission may include a lead screw coupled to the actuation member 210, a ball screw coupled to the actuation member 210, a rack and pinion arrangement where the rack may be coupled to the actuation member 210, etc. In several alternate embodiments, the actuator 209 may be a member made from a Shape-Memory-Alloy (SMA), that may expand when heated through the application of electrical power and return to its original state when the electrical power is disconnected. In that, regard, the actuator 209 may also be a thermal actuator working on the same principle as SMAs. In several embodiments, combinations of two or more of the aforementioned types of actuators may be used as the actuator 209.

During the use of the modular sealing apparatus 200, the electrical drive unit 208 is configured to cause the cap module 202 to move upwards and against the counterpart 108, by activating the actuation member 210. The actuation member 210 in that regard may be a solid or a hollow shaft coupled to the actuator 209. To accommodate the actuation member 210, the central portion 236 includes at least one support cavity 211 in a lower portion of the central portion 236. The at least one support cavity 211 is configured to receive therewithin the actuation member 210. Furthermore, at least one support cavity scaling ring 207 may further be provided to provide sealing between the actuation member 210 and the at least one support cavity 211. For example, FIGS. 2A and 2B illustrate two actuation members 210, therefore two support cavities 211 and two support cavity scaling rings 207 have been provided. It is to be noted here, that for the embodiment of FIGS. 2A and 2B, in addition to providing linear motion, the two actuation members 210 also provide mechanical support for resting the cap module 202 onto the two actuation members 210. In several alternate embodiments, the at least one support cavity 211 may be provided in the at least one end connection portion 238. In other words, the at least one support cavity 211 may be provided anywhere in a lower portion of the cap module 202.

The actuation member 210 may be coupled to the cap module 202 using a snap-fit arrangement or a friction-based fastening for convenient removal and reassembly of the cap module 202 from above the actuation box 204. Furthermore, a portion of the actuation member 210 protruding outside the actuation box 204 has been protected from environmental elements by encapsulation using an actuation member sleeve 205 and an actuation member sealing ring 212. The actuation member sleeve 205 and the actuation member sealing ring 212 prevent environmental elements like dust, moisture, etc. from entering the actuation box 204 and the electrical drive unit 208 ensuring their durability and longevity. The electrical power for the electrical drive unit 208 comes from the vacuum chamber machine 100 through the interface module 206. In that regard, an installation box 230 may be fastened to each one or both of two external walls 109 corresponding to the two respective internal walls 107 of FIGS. 2A and 2B, using an installation box holder 228. The installation box holder 228 may be a metallic bracket fastened to the external wall 109 using fasteners such as screws, nuts, bolts, adhesives, etc., and the installation box 230 may be magnetically coupled to the installation box holder 228. The installation box 230 may include conducting elements for conducting the electrical power from the power input of the machine 100 to the actuation box 204, via the interface module 206 (See FIG. 7). Furthermore, the installation box 230 may also include conducting elements for conducting at least one of sensor data or control signals between the actuation box 204 and a machine control architecture (See FIG. 8) of the machine 100. The actuation box 204 may be provided with electrical/electronic components such as resistors, capacitors, switches, etc. mounted on a Printed Circuit Board (PCB) to distribute the electrical power to several different components of the modular sealing apparatus 200.

The actuation box 204 further includes a first contact member 214 in an upper portion of the actuation box 204. In an embodiment, the electrical power unit 217 of the cap module 202 is configured to receive the electrical power for the heating wire 232, from the actuation box 204, through the first contact member 214. In several embodiments, the first contact member 214 may also supply the electrical power to a sensor module (See FIGS. 6A-6C) of the cap module 202. The sensor module (See FIGS. 6A-6C) has been discussed in greater detail in the following description. Alternately, the electrical power supply to the sensor module (See FIGS. 6A-6C) and the heating wire 232 may be segregated, and a second contact member 222 may be used to supply the electrical power to the sensor module (See FIGS. 6A-6C). It is to be noted here that embodiments with one and more than one contact members, such as the first contact member 214, are all envisaged to be within the scope of the present disclosure.

In that regard, the first contact member 214 is envisaged to be made from an electrically conducting material, such as copper. Moreover, the first contact member 214 is supported by a first deformable element 220, allowing the first contact member 214 to always make contact with the electrical power unit 217, for as long as the modular sealing apparatus 200 is in use. In several embodiments, the first deformable element 220 may be selected from a group consisting of compression springs, tension springs, cantilever springs, constant force springs, elastomer-based elements, and combinations thereof. The first contact member 214 is partially located within the actuation box 204 and partially protrudes outwards from the upper portion of the actuation box 204. Further, to prevent the first contact member 214 from environmental elements such as heat, dust, moisture, etc. the first contact member 214 has been encapsulated within a first upper sleeve 216 and a first lower sleeve 218. In several embodiments, the first upper sleeve 216 sockets the first lower sleeve 218. In several alternate embodiments, the first lower sleeve 218 sockets the first upper sleeve 216. Furthermore, a first sealing ring 213 has been provided between the first upper sleeve 216 and the first lower sleeve 218.

The actuation box 204 further includes the second contact member 222 in the upper portion of the actuation box 204. The second contact member 222 is configured to supply electrical power to a sensor module (See FIGS. 6A-6C) of the cap module 202. The sensor module is configured to sense at least one temperature value in an upper portion of the cap module 202. In that regard, the second contact member 222 is envisaged to be made from an electrically conducting material, such as copper. Moreover, the second contact member 222 is supported by a second deformable element 223, allowing the second contact member 222 to always make contact with the sensor module, for as long as the modular sealing apparatus 200 is in use. In several embodiments, the second deformable element 223 may be selected from a group consisting of compression springs, tension springs, cantilever springs, constant force springs, elastomer-based elements, and combinations thereof.

The second contact member 222 is partially located within the actuation box 204 and partially protrudes outwards from the upper portion of the actuation box 204. Further, to prevent the second contact member 222 from environmental elements such as heat, dust, moisture, etc. the second contact member 222 has been encapsulated within a second upper sleeve 224 and a second lower sleeve 226. In several embodiments, the second upper sleeve 224 sockets the second lower sleeve 226. In several alternate embodiments, the second lower sleeve 226 sockets the second upper sleeve 224. Furthermore, a second sealing ring 215 has been provided between the second upper sleeve 224 and the second lower sleeve 226. In addition to providing actuation and conduction of electrical power, the actuation members 210, the first contact member 214, and the second contact member 222 also provide structural support to the cap module 202 above the actuation box 204.

The interface module 206 includes at least one dock 240 and at least one respective channel 242. FIGS. 2A and 2B illustrate two docks 240 and two channels 242, one dock 240 and one channel 242 on each of the left side and the right side of the actuation box 204. The two docks 204 are configured to removably mate with the two internal walls 107 of the vacuum chamber 106. In that regard, the two docks 204 may be fastened to the two respective internal walls 107 through magnetic fasteners, adhesive tape, screws, nuts, bolts, loop and hook fasteners, and the like. The two channels 242 have been provided in the two respective docks 240 and allow the actuation box 204 to slide in and detachably couple with the interface module 206. In that regard, in several embodiments, the two channels 242 may be provided as slots within the two respective docks 240, and the actuation box 204 may be provided with lateral protrusions on each of the left and the right sides of the actuation box 204. The lateral protrusions may slide into the two respective channels 242 to detachably couple the actuation box 204 with the interface module 206. Furthermore, the lateral protrusions may be removably attached to the actuation box 204 or integrally formed with the actuation box 204.

Furthermore, FIGS. 2A and 2B illustrate at least one actuation box shoe 227 provided in a lower portion of the actuation box 204, and at least one interface module shoe 229 provided in a lower portion of the interface module 206. The at least one actuation box shoe 227 and the at least one interface module shoe 229 prevent direct contact of the apparatus 200 with a floor surface of the cavity 103. Therefore, the at least one actuation box shoe 227 and the at least one interface module shoe 229 prevent the actuation box 204 and the interface module 206, respectively from coming in contact with any fluids or debris that might be present of the floor of the cavity 103, enabling maintenance of hygiene and longevity of the apparatus 200. In several embodiments, one or both of the at least one actuation box shoe 227 and the at least one interface module shoe 229 may be provided with a quick-release fastening arrangement such as adhesives, loop and hook fasteners, magnets (permanent or electromagnets), snap-fit arrangements, etc. to removably fasten the actuation box 204 and the interface module 206, respectively, to the floor of the cavity 103. The quick-release fastening arrangement would therefore ensure the stability and steadiness of the actuation box 204 and the interface module 206 when the apparatus 200 is in use.

Figure 2C:
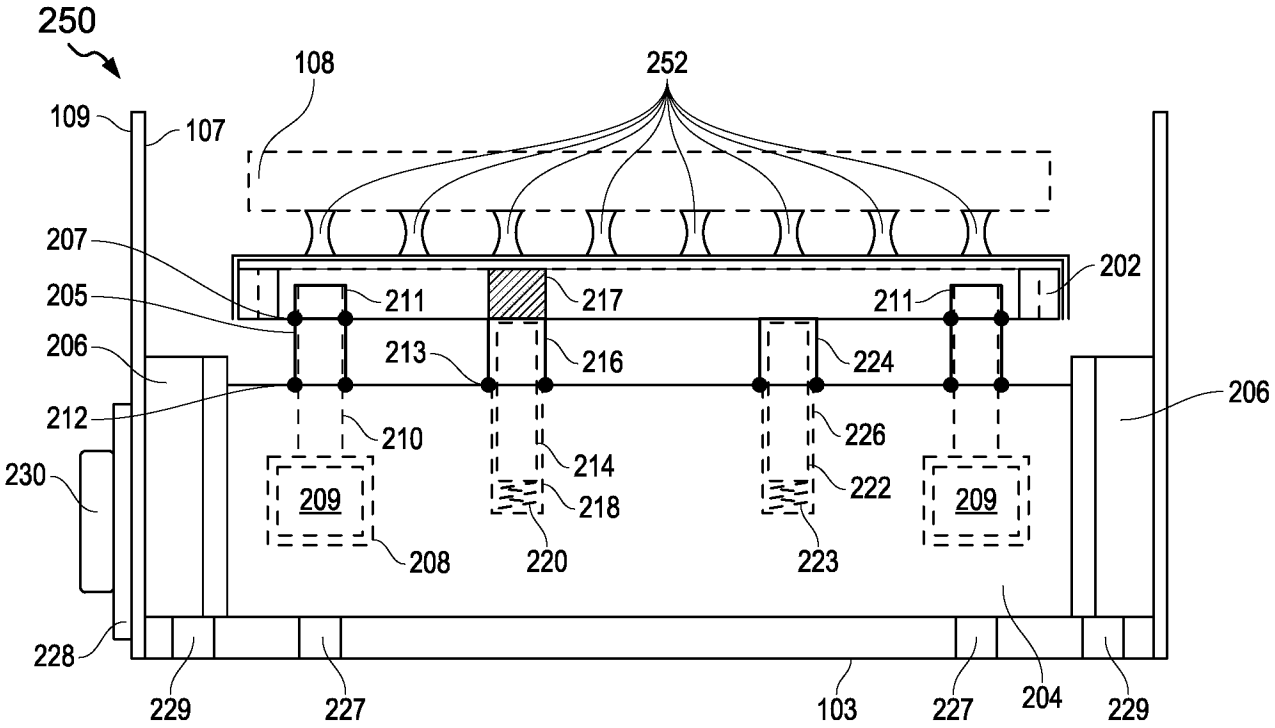
FIG. 2C illustrates a front view of a modular sealing apparatus, in accordance with another embodiment of the present disclosure.

FIG. 2C illustrates a front view of a modular sealing apparatus 250, in accordance with another embodiment of the present disclosure. FIG. 2C illustrates a plurality of counterpart protrusions 252 provided at a bottom surface of the counterpart 108. It is envisaged that the plurality of counterpart protrusions 252 are made of deformable and compressible material. In that regard, when the apparatus 250 is not in use, the plurality of counterpart protrusions 252 is long enough to fill a gap between the bottom surface of the counterpart 108 and a top surface of the cap module 202. Whereas, when in use, as the cap module 202 is pushed against the counterpart 108, the plurality of counterpart protrusions 252 is deformed and compressed to enable the melding of the packet 112. The plurality of counterpart protrusions 252 have been provided to prevent repositioning of the packet 112 during the melding process. In several embodiments, the plurality of counterpart protrusions 252 may be provided with a weak adhesive material to enable removable attachment of the packet 112 to further stabilize the positioning of the packet 112 during the melding process.

Figure 3A:
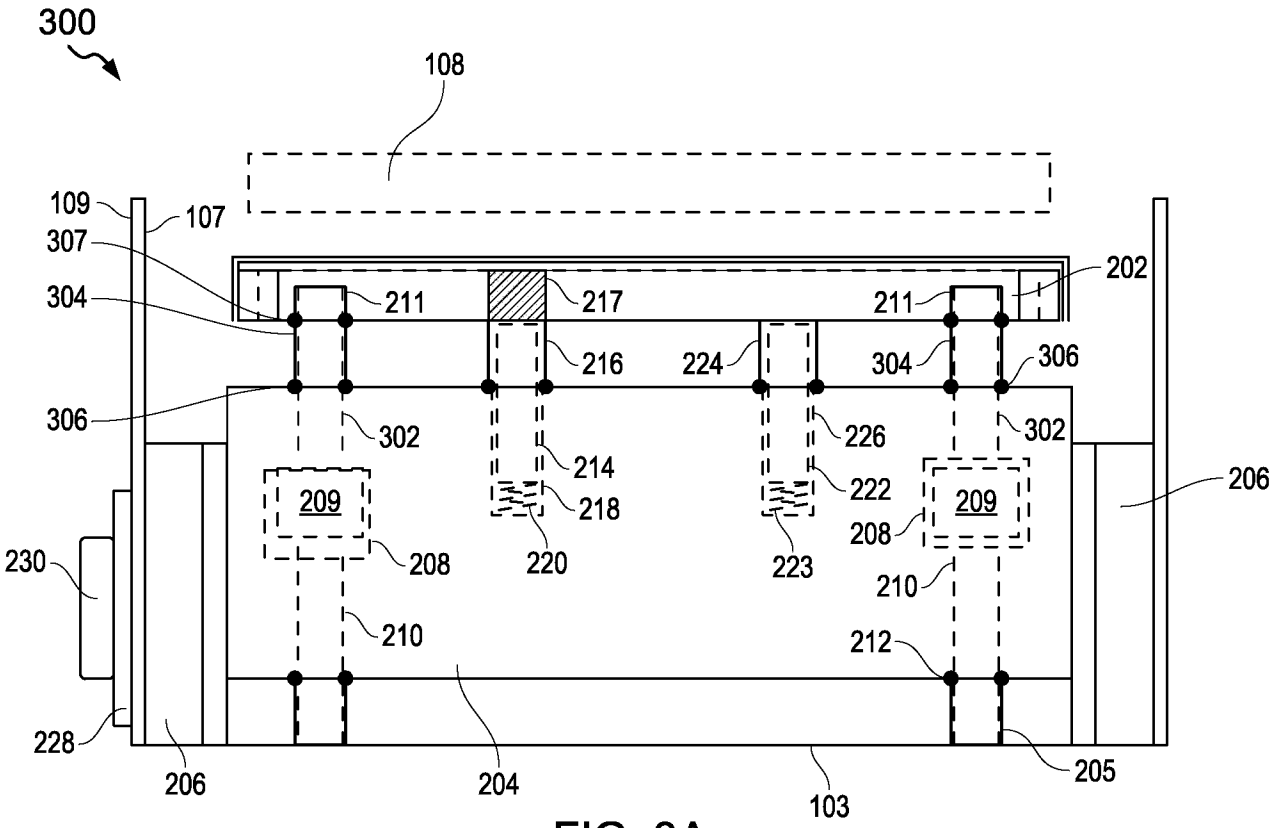
FIG. 3A illustrates a front view of a modular sealing apparatus, in accordance with another embodiment of the present disclosure.
Figure 3B:
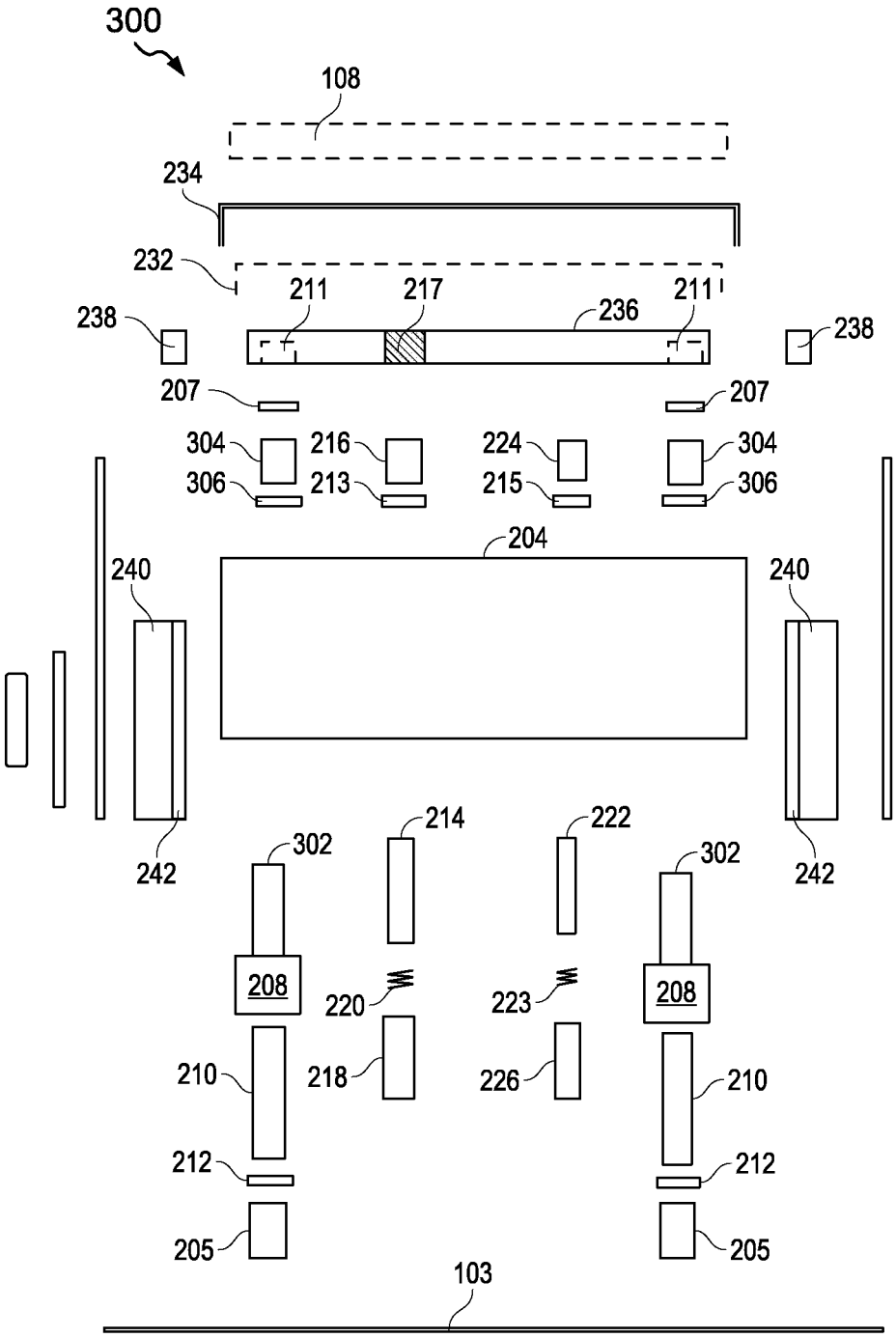
FIG. 3B illustrates an exploded view of the modular sealing apparatus of FIG. 3A.

FIG. 3A illustrates a front view of a modular sealing apparatus 300 (or "the apparatus 300"), in accordance with another embodiment of the present disclosure. FIG. 3B illustrates an exploded view of the modular sealing apparatus 300 of FIG. 3A. As illustrated in FIGS. 3A and 3B, the actuation members 210 are located in a lower portion of the actuation box 204. Furthermore, the actuation members 210 are resting against the floor of the cavity 103 of the vacuum chamber 106. Moreover, the actuation member sleeve 205 and the actuation member sealing ring 212 have been located below the actuation box 204. The cap module 202 is supported by at least one upper support member 302. To accommodate the at least one upper support member 302, the central portion 236 includes the at least one support cavity 211 in the lower portion of the central portion 236. The at least one support cavity 211 is configured to receive therewithin the at least one upper support member 302. Furthermore, at least one support cavity sealing ring 207 may further be provided to provide sealing between the at least one upper support member 302 and the at least one support cavity 211.

For example, FIGS. 3A and 3B illustrate two upper support members 302, therefore two support cavities 211 and two support cavity sealing rings 207 have been provided. It is to be noted here, that for the embodiment of FIGS. 3A and 3B, the upper support members 302 are the elements that provide mechanical support for resting the cap module 202 onto the two upper support members 302. In several alternate embodiments, the at least one support cavity 211 may be provided in the at least one end connection portion 238. In other words, the at least one support cavity 211 may be provided anywhere in a lower portion of the cap module 202. The at least one upper support member 302 may be coupled to the cap module 202 using a snap-fit arrangement or a friction-based fastening for convenient removal and reassembly of the cap module 202 from above the actuation box 204. FIGS. 3A and 3B illustrate two upper support members 302. The portions of the two upper support members 302 that are protruding out of the actuation box 204 are encapsulated by two respective support member sleeves 304 and two respective support members scaling rings 306 to prevent environmental elements from entering the actuation box 202.

During the operation of the modular sealing apparatus 300, when the actuator 209 is activated, the actuation members 210 in the lower portion of the actuation box 204 are configured to cause the actuation box 204 and the cap module 202 to together move upwards and downwards relative to the counterpart 108. In that regard, during the operation of the modular sealing apparatus 300, the actuation box 204 slides along the two channels 242 of the two respective docks 240 located on the left and the right sides of the actuation box 204. In several embodiments, the two upper support members 302 may also be spring loaded (not shown), allowing relative motion between the actuation box 204 and the cap module 202, after the cap module 202 has made contact with the counterpart 108. The spring-loaded upper support members 302 thus would allow a variable pressure or contact force to be exerted by the cap module 202 onto the counterpart 108.

Figure 4A:
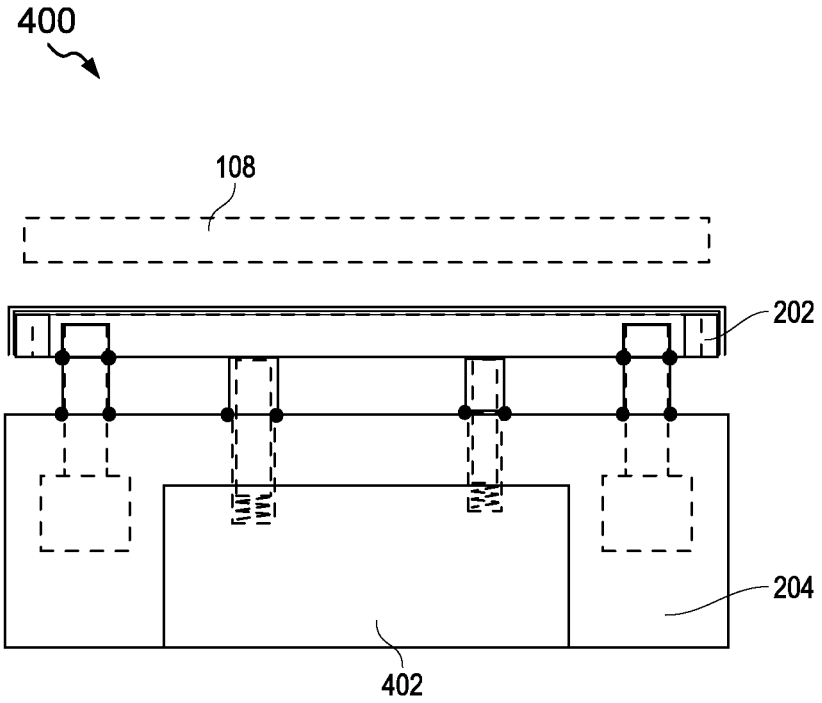
FIG. 4A illustrates a front view of a modular sealing apparatus, in accordance with another embodiment of the present disclosure.
Figure 4B:
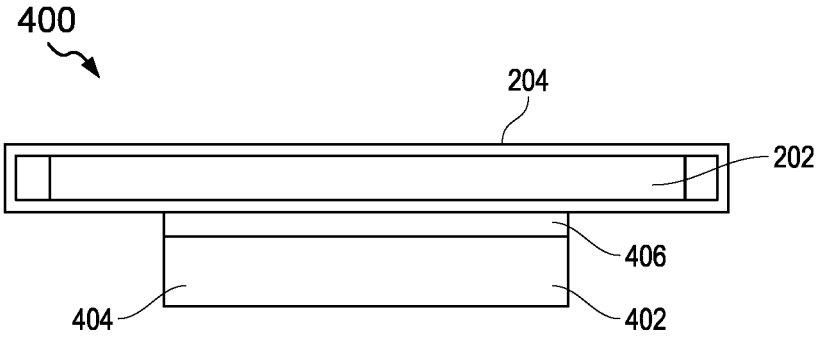
FIG. 4B illustrates a top view of the modular sealing apparatus of FIG. 4A.

FIG. 4A illustrates a front view of a modular scaling apparatus 400 (or "the apparatus 400"), in accordance with another embodiment of the present disclosure. FIG. 4B illustrates a top view of the modular sealing apparatus 400 of FIG. 4A. FIGS. 4A and 4B illustrate the modular sealing apparatus 400 including an interface module 402. The interface module 402 includes a single dock 404 and a single channel 406 provided on a front side of the actuation box 204. In that regard, the interface module 402 is configured to mate and detachably attach with an internal wall 107 on a front side of the vacuum chamber 106. In several alternate embodiments, the interface module 402, including the single dock 404 and the single channel 406 may be provided on a rear side of the actuation box 204. In such a scenario, the interface module 402 would be configured to mate and detachably attach with an internal wall 107 on a rear side of the vacuum chamber 106. Furthermore, a front or a rear protrusion may be provided with the actuation box 204 on the front side or the rear side, respectively, of the actuation box 204. The front protrusion may slide into the single channel 406 when the interface module 402 is provided on the front side of the actuation box 204, and the rear protrusion may slide into the single channel when the interface module 403 is provided on the rear side of the actuation box 204. In each case, the actuation box 204 would be detachably coupled to the interface module 402. Furthermore, the front or the rear protrusions may be removably attached to the actuation box 204 or integrally formed with the actuation box 204.

Figure 4C:
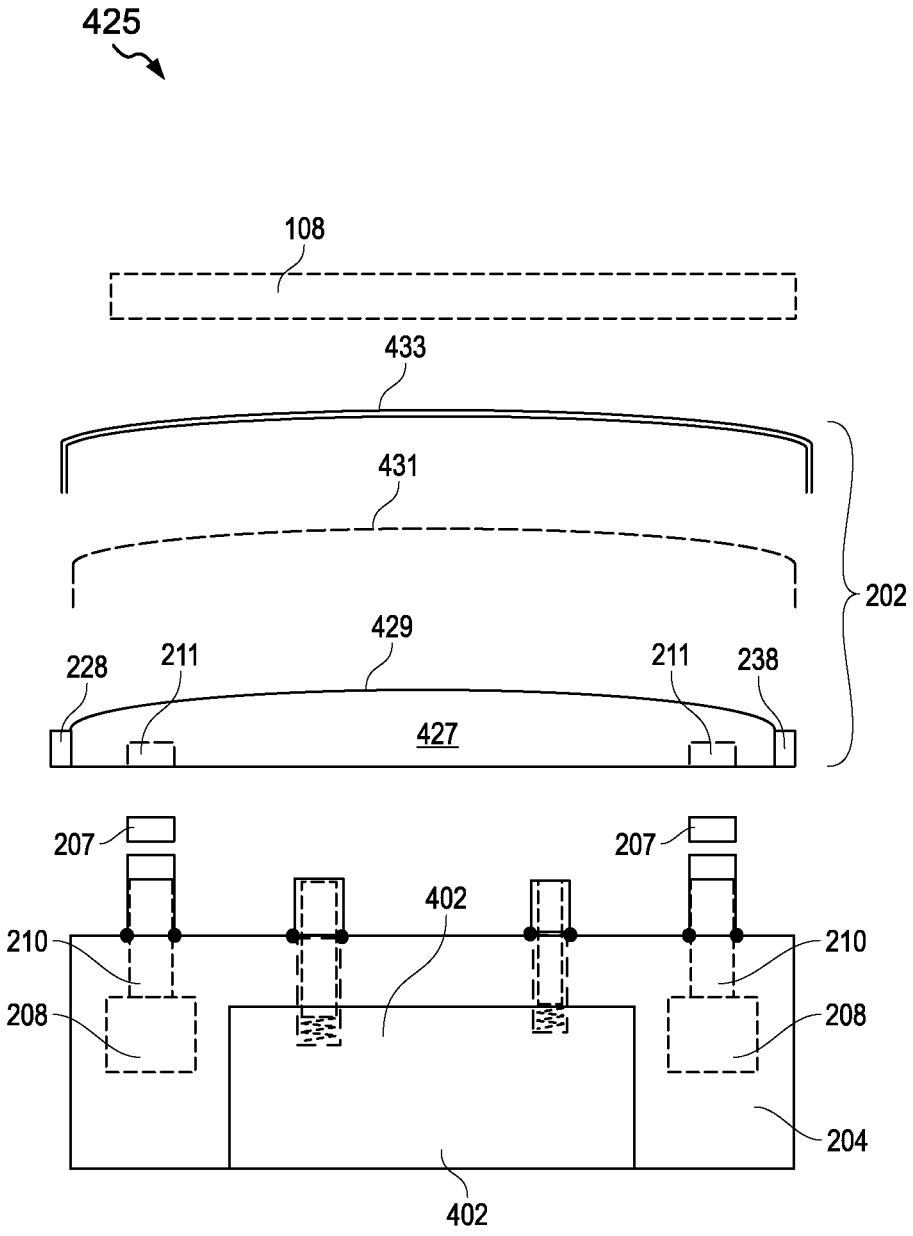
FIG. 4C illustrates a partially exploded view of a modular sealing apparatus, in accordance with another embodiment of the present disclosure.

FIG. 4C illustrates a partially exploded view of a modular sealing apparatus 425 (or "the apparatus 425"), in accordance with another embodiment of the present disclosure. The cap module 202 of the modular sealing apparatus 425 has been modified and exploded for explanation purposes. The cap module 202 includes a modified central portion 427 when compared with the conventional heating bar 110 of the conventional vacuum packaging machine 100. In the modified central portion 427, a modified upper surface 429 of at least the modified central portion 427 is bent upwards forming an upward convex geometry. Furthermore, the cap module 202 of the modular scaling apparatus 425 includes a modified heating wire 431 and a modified protective film 433 conforming with the upward convex geometry of the modified central portion 427. The upward convex geometry of the modified upper surface 429, the modified heating wire 431, and the modified protective film 433 allow enhanced pressure or contact force to be applied between the cap module 202 and the counterpart 108 during the vacuum packaging of the packet 112. Furthermore, the upward convex geometry also enables the shearing of excess material from the packet 112 after the packet 112 has been vacuum packaged.

Figure 4D:
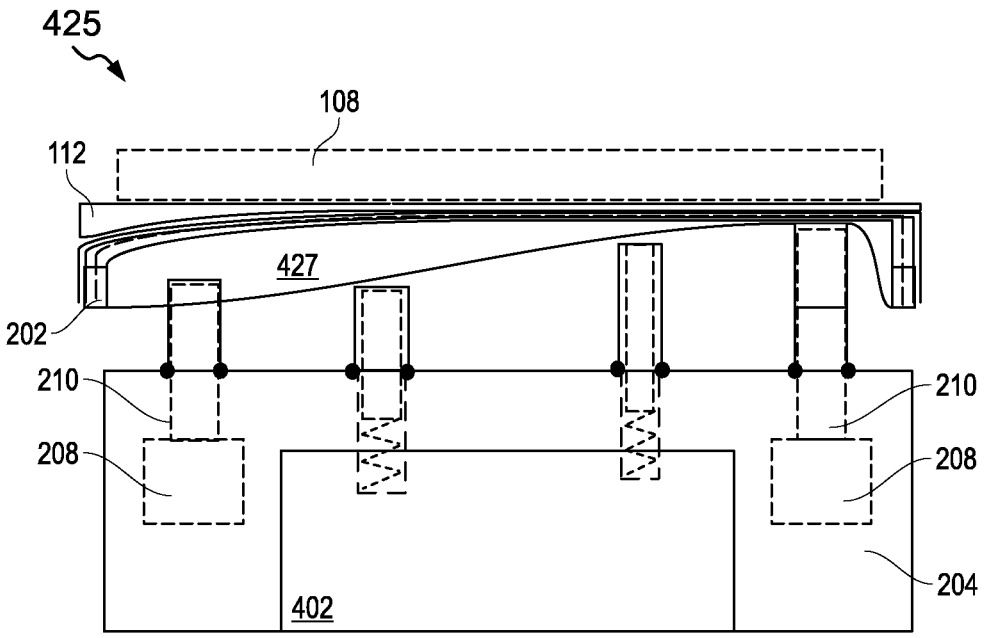
FIG. 4D illustrates an application scenario of the modular sealing apparatus of FIG. 4C.

FIG. 4D illustrates an application scenario of the modular sealing apparatus 425 of FIG. 4C. The apparatus 425 illustrates two electrical drive units 208 and two respective actuation members 210. In several alternate embodiments, the apparatus 425 may include more than two electrical drive units 208 and more than two respective actuation members 210. Furthermore, it is envisaged that at least the modified central portion 427 is made from a deformable material. In several embodiments, in use, the two or more electrical drive units 208 may be provided with disparate amounts of electrical power resulting in disparate magnitudes of linear motion of the two or more actuation members 210. With the ability of the modified central portion 427 to be deformable, combined with disparate actuation of the two or more actuation members 210, geometry of the cap module 202 may be modified to achieve disparate predetermined geometries of space between the counterpart 108 and the cap module 202, in conformance with disparate respective predetermined geometries of disparate respective packets to be sealed. As illustrated in FIG. 4D, the actuation member 210 on a right side of the apparatus 425 is moved upwards by a greater magnitude when compared with the actuation member 210 on a left side of the apparatus 425. The consequent deformation of the modified central portion 427 has resulted in a geometry of space between the cap module 202 and the counterpart 108 which is convex-curved upwards on the left side and substantially horizontally-straightened on the right side.

Figure 5A:
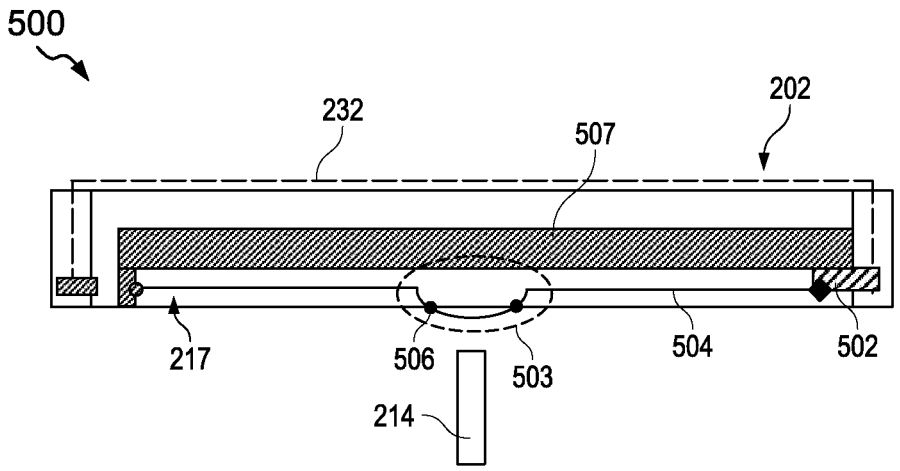
FIG. 5A illustrates an electrical routing for supplying electrical power to a heating wire of the modular sealing apparatus, in accordance with an embodiment of the present disclosure.

FIG. 5A illustrates an electrical routing 500 for supplying electrical power to the heating wire 232 of the modular scaling apparatus 200, 250, 300, 400, or 425 in accordance with an embodiment of the present disclosure. The electrical routing 500 includes a contact port 502 provided at one end of the heating wire 232. The electrical power unit 217 includes a conductor spring strip 504 electrically connected to the contact port 502. The conductor spring strip 504 is envisaged to be made up of electrically conducting material. In several embodiments, at least a portion of the conductor spring strip 504 would include an insulating material thereupon to prevent short circuits within the cap module 202. Furthermore, the conductor spring strip 504 includes a deformable portion 503 accessible through an opening in a lower portion of the cap module 202.

The deformable portion 503 is configured to make contact with the first contact member 214 and undergo deformation as the first contact member 214 presses against the deformable portion 503, during the use of the modular sealing apparatus 200, 250, 300, 400, or 425. The electrical power may be supplied to the heating wire 232 through the first contact member 214, the conductor spring strip 504, and the contact port 502. Since the deformable portion 503 is accessible through the opening in the lower portion of the cap module 202, a lower sealing element 506 such as a gasket, a filler material, a sealing gel, a sealing ring, etc. may be provided between the deformable portion 503 and the lower portion of the cap module 202 to prevent entry of the environmental elements into the cap module 202. Furthermore, an isolating bar 507 made up of insulating material may be provided above the conductor spring strip 504 to at least one of isolate the conductor spring strip 504 or guide deformation or extension of the conductor spring strip 504 when the deformable portion 503 expands or contracts.

Figure 5B:
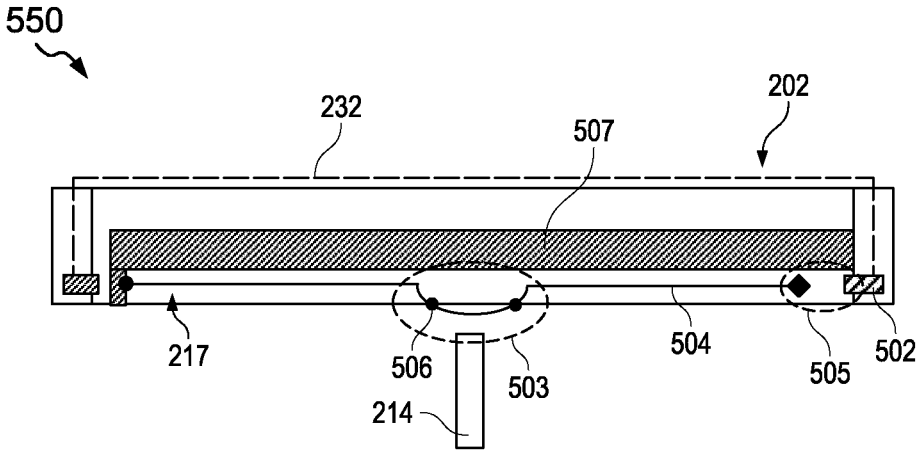
FIG. 5B illustrates an electrical routing for supplying the electrical power to the heating wire, in accordance with another embodiment of the present disclosure.

FIG. 5B illustrates an electrical routing 550 for supplying the electrical power to the heating wire 232, in accordance with another embodiment of the present disclosure. The electrical routing 550 includes a predetermined gap 505 between the contact port 502 and an open end of the conductor spring strip 504. The predetermined gap 505 is traversed by the conductor spring strip 504 when the deformable portion 503 undergoes a minimum predetermined deformation in response to a minimum predetermined pressure exerted by the first contact member 214 on the deformable portion 503. The pressure may be exerted by the first contact member 214 onto the deformable portion 503 when the cap module 202 is in contact with the counterpart 108 and the actuation member(s) 210 continues to cause the cap module 202 to translate upwards. Thus, the predetermined gap 505 would act as a safety feature to ensure that the electrical power is supplied to the heating wire 232 only when there is a minimum predetermined pressure or contact force between the cap module 202 and the counterpart 108. One or more of the predetermined gap 505, the material of the conductor spring strip 502, and a profile of the deformable portion 503 may be calibrated for a desired predetermined pressure or contact force between the cap module 202 and the counterpart 108. The safety feature including the predetermined gap 505 may thus be applicable in both the feedforward scenarios and feedback scenarios where a pressure sensor may be included in at least one of the cap module 202 or the counterpart 108.

Figure 6A:
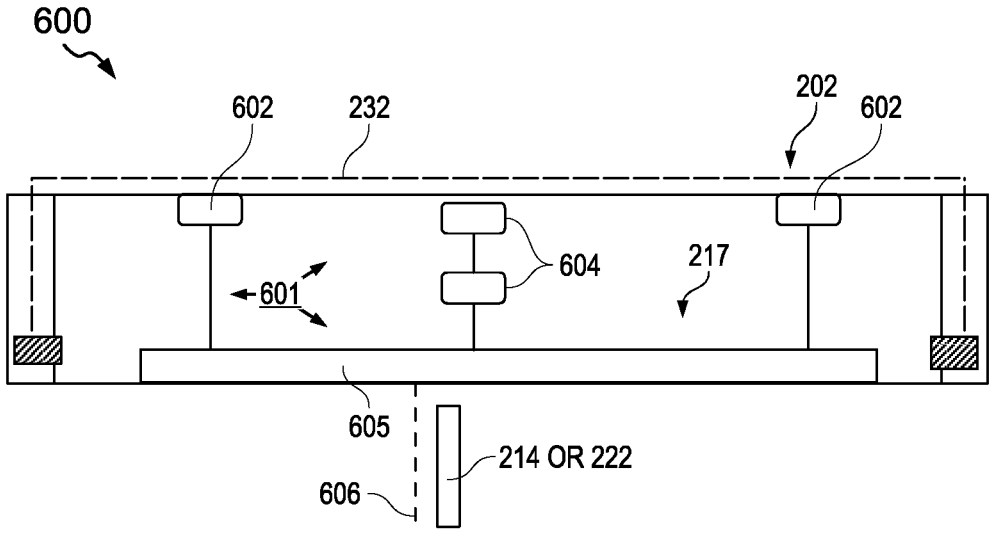
FIG. 6A illustrates an electrical routing for supplying electrical power to a sensor module of the modular sealing apparatus, in accordance with an embodiment of the present disclosure.

FIG. 6A illustrates an electrical routing 600 for supplying electrical power to a sensor module 601 of the modular scaling apparatus 200, 250, 300, 400, or 425, in accordance with an embodiment of the present disclosure. The sensor module 601 includes a Printed Circuit Board (PCB) 605. The PCB 605 may be configured to receive the electrical power from one or both of the first contact member 214 and the second contact member 222. Therefore, in several embodiments, the PCB 605 may be regarded as a part of the electrical power unit 217. Furthermore, the sensor module 601 includes one or more sensors, such as one or more first sensors 602 and one or more second sensors 604 connected to the PCB 605. The one or more first sensors 602 are located in the upper portion of the cap module 202. The one or more first sensors 602 are selected from a group consisting of temperature sensors, force sensors, pressure sensors, and the like. Furthermore, the one or more first sensors 602 may be contact-based sensors or non-contact-based sensors. The temperature sensors may be selected from a group consisting of thermistors, thermocouples, Semiconductor-based Integrated Circuits (ICs), infrared sensors, fiber-optic sensors, etc. The temperature sensors may be used to sense the temperature of the heating wire 232.

The force sensors and the pressure sensors may be selected from a group consisting of strain gauges, piezoelectric sensors, capacitive sensors, inductive sensors, magnetoelastic sensors, resonant sensors, and optical sensors. The force and the pressure sensors may be used to sense at least one of the contact force or the pressure between the cap module 202 and the counterpart 108. In several embodiments, the one or more second sensors 604 may include temperature sensors to measure the temperature of the heating wire 232. In several embodiments, the one or more second sensors 604 includes at least two second sensors 604 located at two different heights above the PCB 605. One second sensor 604 may be located in the upper portion of the cap module 202 to sense the temperature of the heating wire 232. Another second sensor 604 may be located in the middle portion (vertically) of the cap module 202 to provide compensation temperature of an environment surrounding the heating wire 232. Furthermore, at least one data connection 606 has been provided between the cap module 202 and the actuation box 204. The at least one data connection 606 is configured to transmit sensor data from the sensor module 601 to the actuation box 204. In several embodiments, the at least one data connection 606 may be a hardware line. In several alternate embodiments, the at least one data connection 606 may be a wireless connection following a wireless protocol such as Bluetooth, ZigBee or any other Radio-Frequency (RF) based connection. The sensor data may then be transmitted to and processed by the machine control architecture (See FIG. 8) of the machine 100 or a controller (See FIG. 9) of the actuation box 204.

Figure 6B:
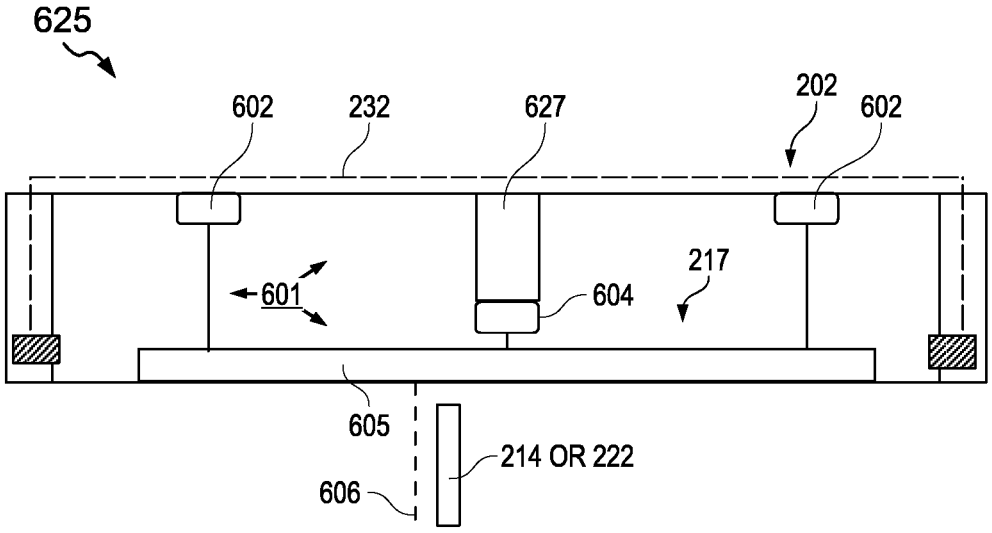
FIG. 6B illustrates an electrical routing for supplying the electrical power to the sensor module, in accordance with another embodiment of the present disclosure.

FIG. 6B illustrates an electrical routing 625 for supplying the electrical power to the sensor module 601, in accordance with another embodiment of the present disclosure. The electrical routing 625 illustrates the use of a heat pipe 627 to transfer heat from the heating wire to one of the one or more second sensors 604. In that manner, the respective second sensor 604 may be located a distance from the heating wire 232. The heat pipe 627 would allow heat to be transferred reliably and efficiently from the heating wire 232 to the respective second sensor 604, without the second sensor 604 being exposed to electromagnetic interference caused due to electrical current flowing in the heating wire 232. This will allow relatively accurate sensing of the temperature of the heating wire 232 and reliable signaling by the one or more second sensors 604.

Figure 6C:
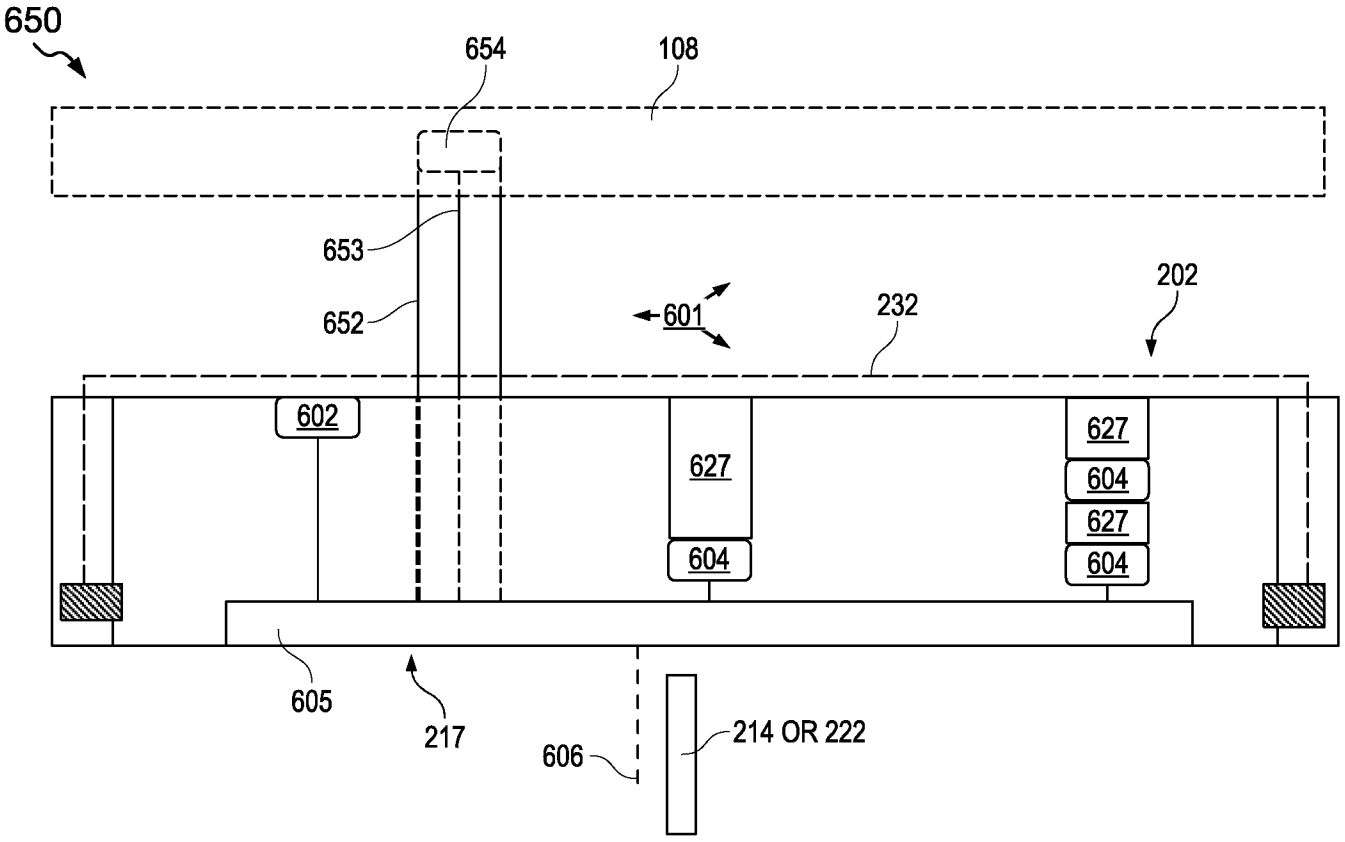
FIG. 6C illustrates an electrical routing for supplying electrical power to one or more counterpart sensors in a counterpart of the vacuum packaging machine, in accordance with an embodiment of the present disclosure.

FIG. 6C illustrates an electrical routing 650 for supplying electrical power to one or more counterpart sensors 654 in the counterpart 108, in accordance with an embodiment of the present disclosure. The one or more counterpart sensors 654 may include at least one temperature sensor, and may further include force sensors and pressure sensors. Furthermore, the one or more counterpart sensors 654 may be located in a lower portion of the counterpart 108 to sense at least one temperature value in the lower portion of the counterpart 108. Furthermore, the one or more counterpart sensors 654 may be connected with the sensor module 601 through a counterpart sensor data and power line 653 running through a channel 652 that may traverse a gap between the cap module 202 and the counterpart 108 and portions of the cap module 202 and the counterpart 108. It is further envisaged that the channel 652 is at least one of collapsible or extendible allowing the cap module 202 to move upwards and downwards relative to the counterpart 108.

A person skilled in the art would appreciate that in several embodiments, the first contact member 214 may alone be used to provide the electrical power to both the heating wire 232 and the sensor module 601. When only the first contact member 214 is being used to supply the electrical power to both the heating wire 232 and the sensor module 601, the PCB 605 may be provided with switches, buck-boost converters, amplifiers, etc. for meeting different power demands of the heating wire 232 and the sensor module 601 at different time intervals. For instance, the heating wire 232 may be supplied with the electrical power only during melding process, while the sensor module 601 may require the electrical power at all times during the operation of the modular sealing apparatus 200, 250, 300, 400, 425, or 900 (See FIG. 9). Moreover, the amounts of electrical power required by the heating wire 232 and the sensor module 601 may also be different. For instance, the sensor module 601 will require relatively substantially lower amounts of the electrical power when compared with the heating wire 232. Alternately or in addition, the amount of the electrical power being supplied through the first contact member 214 at different time intervals may be varied and controlled by the machine control architecture (See FIG. 8) of the machine 100 or the controller (See FIG. 9) of the actuation box 204. Furthermore, in several embodiments, when the at least one data connection 606 is a hardware line, the at least one data connection 606 may be provided within the first upper sleeve 216 and the first lower sleeve 218, thereby preventing the at least one data connection 606 from damage due to environmental elements.

However, in several embodiments, where power conservation with relatively lesser switching complexity may be desired, since the sensor module 601 is envisaged to consume less power when compared to the heating wire 232, the electrical power supplies to the sensor module 601 and the heating wire 232 may be segregated. In such a scenario, the first contact member 214 may alone supply the electrical power to the heating wire 232 and the second contact member 222 may alone supply the electrical power to the sensor module 601. Furthermore, in several embodiments, when the at least one data connection 606 is a hardware line, the at least one data connection 606 may be provided within the second upper sleeve 224 and the second lower sleeve 226, thereby preventing the at least one data connection 606 from damage due to environmental elements.

Figure 7:
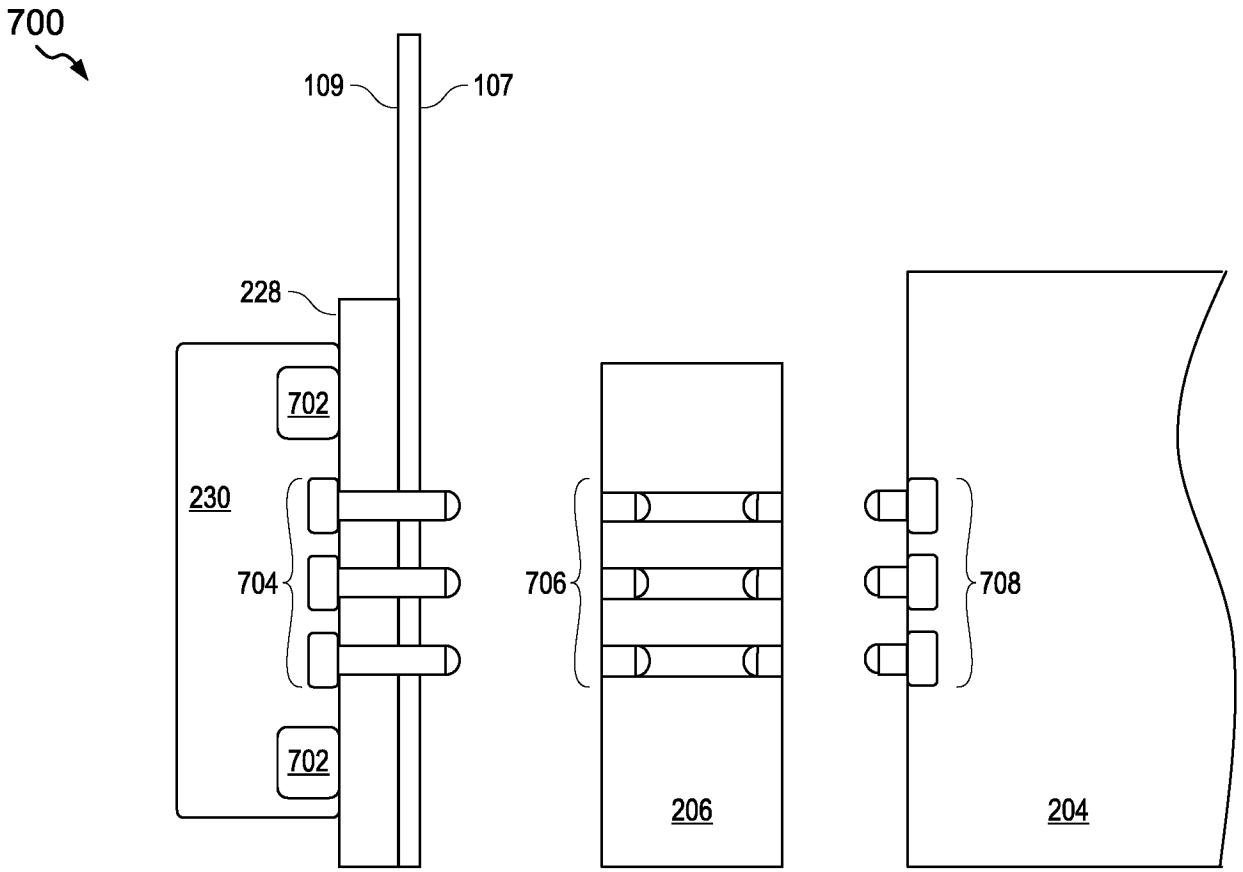
FIG. 7 illustrates an arrangement for at least one of supplying electrical power to an actuation box of the modular sealing apparatus from an electrical supply of the vacuum packaging machine or supplying sensor data from a sensor module to a machine control architecture of the vacuum packaging machine, in accordance with an embodiment of the present disclosure.

FIG. 7 illustrates an arrangement 700 for at least one of supplying the electrical power to the actuation box 204 from the electrical supply of the vacuum packaging machine 100 or supplying sensor data from the sensor module 601 to the machine control architecture (See FIG. 8) of the vacuum packaging machine 100, in accordance with an embodiment of the present disclosure. The installation box 230 is mechanically coupled to the installation box holder 228 through one or more magnets 702. The one or more magnets 702 may be electromagnets or permanent magnets. In that regard, it is envisaged that the installation box holder 228 is made from a ferromagnetic material such as Iron, Steel, rare earth magnets, Ferrites, Alnico, Permalloy, etc. Furthermore, the installation box 230 includes a plurality of first terminal pins 704 for at least one of an electrical power connection or a data connection with the actuation box 204. For example, the plurality of first terminal pins 704 may include a positive potential pin, a ground/negative potential pin, and a data pin. The positive potential pin and the ground/negative potential pin may be configured to provide electrical power to the actuation box 204, and the data pin may be configured to receive data for example, data from the sensor module 601.

The plurality of first terminal pins 704 may be configured to draw electrical power from the electrical supply of the vacuum packaging machine 100 and also connect to the machine control architecture (See FIG. 8) of the vacuum packaging machine 100 through a data and control line. In several alternate embodiments, there may be two power/positive terminal pins (one for the actuator(s) 209 and one for the heating wire 232), one ground/negative terminal pin, one or more terminal pins for receiving sensor data from the sensor module 601, one terminal pin for switching the actuator(s) 209, and another terminal pin for switching the heating wire 232. A person skilled in the art would appreciate that many such alternate configurations are possible for the plurality of first terminal pins 704, without departing from the scope of the discussion. In that regard, some software or firmware programming and hardware elements (such as AC/DC converters, buck-boost converters, amplifiers, etc.) may be incorporated into the machine control architecture (See FIG. 8) of the vacuum packaging machine 100 to enable control of the modular scaling apparatus 200, 250, 300, 400, or 425 by the control architecture of the vacuum packaging machine 100.

Similarly, the actuation box 204 may include a plurality of second terminal pins 708 complementary to the plurality of respective first terminal pins 704 for electrical connection with the installation box 230. The interface module 206 includes a plurality of double-sided receptacles 706 configured to receive therewithin, the plurality of first terminal pins 704, and the plurality of second terminal pins 708. Furthermore, the plurality of double-sided receptacles 706 is configured to enable electrical conduction between the plurality of first terminal pins 704 and the plurality of respective second terminal pins 708. It is envisaged that the plurality of first terminal pins 704 and the plurality of complementary second terminal pins 708 may be located in the plurality of respective double-sided receptacles 706 without the use of any tool. As the installation box 230 is detachably coupled to the installation box holder 228 using the one or more magnets 702, the plurality of first terminal pins 704 are envisaged to be located in a first side of the plurality of respective double-sided receptacles 706 of the interface module 206 without the use of additional assembly tools such as manual drivers, manual spanners, or electrically or pneumatically powered wrenches or drivers.

For instance, in several embodiments, the plurality of first terminal pins 704 may be spring-loaded. In several alternate embodiments, the plurality of first terminal pins 704 may be connected to at least one stem (not shown) accessible to a user for moving the plurality of first terminal pins 704 forward for at least one of the electrical power connection or the data connection or backward for disconnection. Similarly, as the actuation box 204 is detachably coupled to the interface module 206, through for example the at least one dock 240 and the at least one channel 242, the plurality of second terminal pins 708 are envisaged to be located within a second side, opposite to the first side, of the plurality of respective double-sided receptacles 706 of the interface module 206 without the use of additional assembly tools such as manual drivers, manual spanners, or electrically or pneumatically powered wrenches or drivers. In that regard, it is envisaged that the plurality of second terminal pins 708 may be spring-loaded. In several alternate embodiments, the plurality of second terminal pins 708 may be connected to at least one another stem (not shown) accessible to the user for moving the plurality of second terminal pins 708 forward for the at least one of the electrical power connection or the data connection or backward for disconnection.

Figure 8:
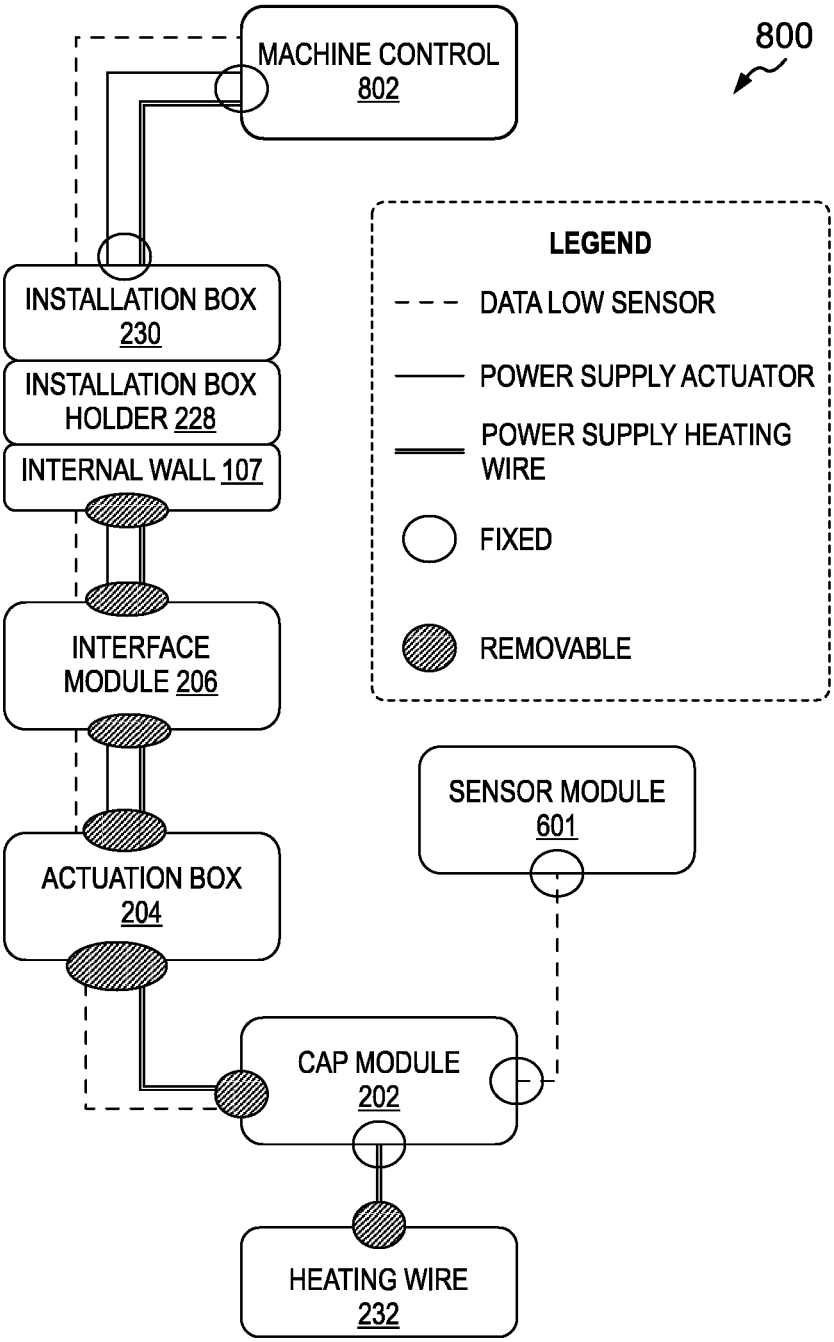
FIG. 8 illustrates electrical connections and routing for electrical signals in a vacuum chamber machine in which the modular sealing apparatus has been installed, in accordance with an embodiment of the present disclosure.

FIG. 8 illustrates electrical connections and routing for electrical signals 800 in the vacuum chamber machine 100 in which the modular scaling apparatus 200, 250, 300, 400, or 425 has been installed, in accordance with an embodiment of the present disclosure. There are two distinct power lines between a machine control architecture 802 and the installation box 230. One power line is for the heating wire 232 and another power line is for the actuator(s) 209. The power line for the heating wire 232 runs up to the cap module 202 via the vacuum chamber 106, the interface module 206, and the actuation box 204. The power line for the actuator(s) runs up to the actuation box 204 via the vacuum chamber 106 and the interface module 206. A data line runs up to the sensor module 601 via the vacuum chamber 106, the interface module 206, the actuation box 204, and the cap module 202. Furthermore, the power line connections downstream of the installation box 230/installation box holder 228/internal wall 107 are removable. Also, the data line connections between the actuation box 204 and the cap module 202 are removable.

Figure 9:
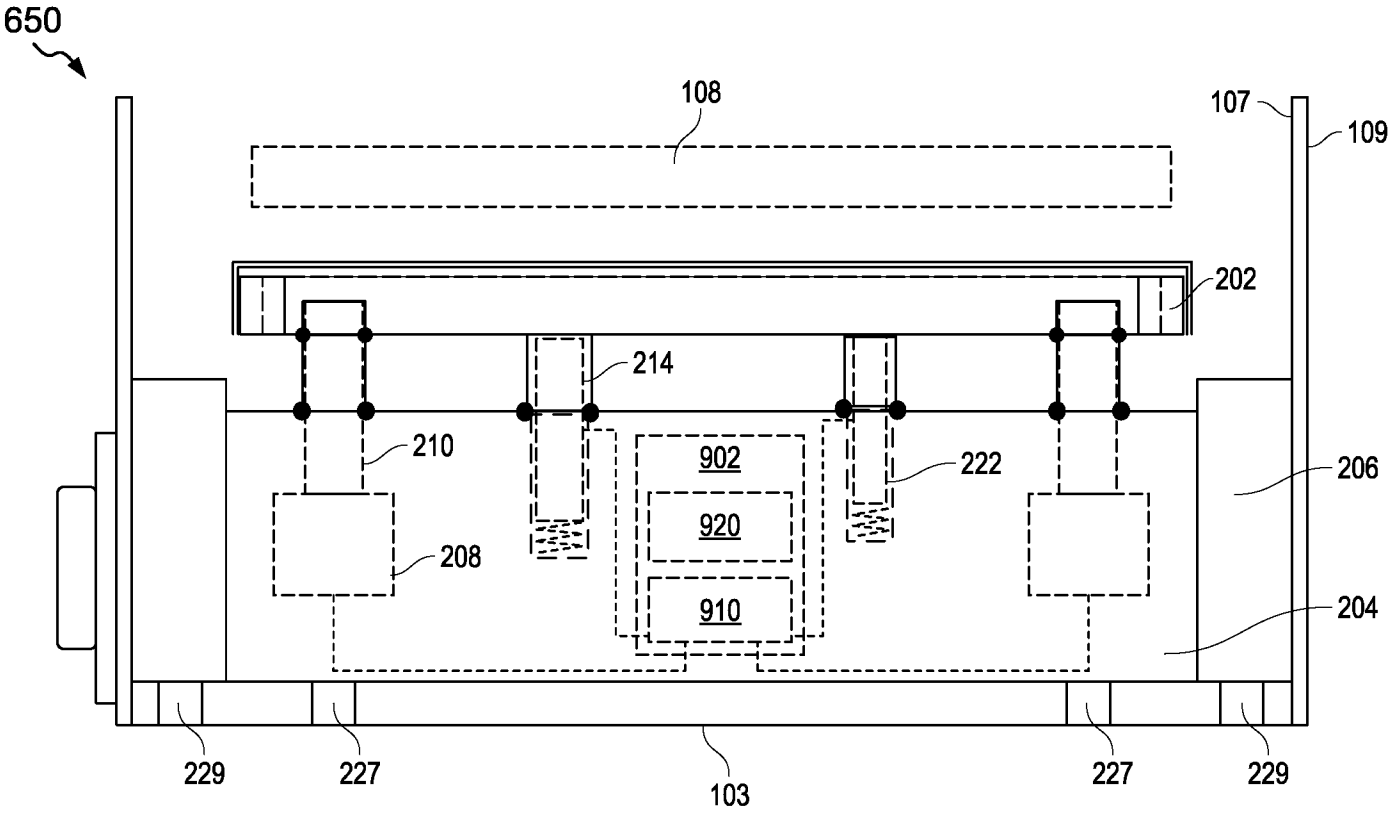
FIG. 9 illustrates a front view of a modular sealing apparatus, in accordance with another embodiment of the present disclosure.

FIG. 9 illustrates a front view of a modular sealing apparatus 900, in accordance with another embodiment of the present disclosure. The modular sealing apparatus 900 is configured to not entirely rely upon the control architecture of the vacuum packaging machine 100. In that regard, the actuation box 202 includes a controller 902. The controller 902 includes a processor 910 and a memory unit 920. The memory unit 920 is operably connected to the processor 910. The processor 910 may be selected from a group consisting of a microcontroller, a general-purpose processor, a System on Chip (SoC), a Field Programmable Gate Array (FPGA), an Application Specific Integrated Circuit (ASIC), and the like. The memory unit 920 may be a non-volatile memory type storage device and may be selected from a group consisting of Solid-State Drives (SSDs), Hard Disk Drives (HDD), flash memory, Non-Volatile Memory Express (NVMe), and the like.

The memory unit 920 may include machine-readable instructions, that when executed by the processor 910 may enable the controller 902 to control one or more of an activation of the actuation member 210, a temperature in a melding zone (i.e. a zone encompassing at least one of contacting portions of the cap module 202 or the counterpart 108 and a predetermined volume of ambient space surrounding the contacting portions of the cap module 202 and the counterpart 108) based on sensor data received from the sensor module 601, and a time period of the melding process. In several alternate embodiments, the controller 902 may also control at least one of a contact force or a pressure between the cap module 202 and the counterpart 108. In such a scenario, the data line of FIG. 8 would extend only between the actuation box 204 and the cap module 202 and may not extend to the machine control architecture 802. The controller 902 may also include additional elements such as AC/DC converters, buck-boost converters, amplifiers, electromechanical/solid-state switches, etc.

Figure 10:
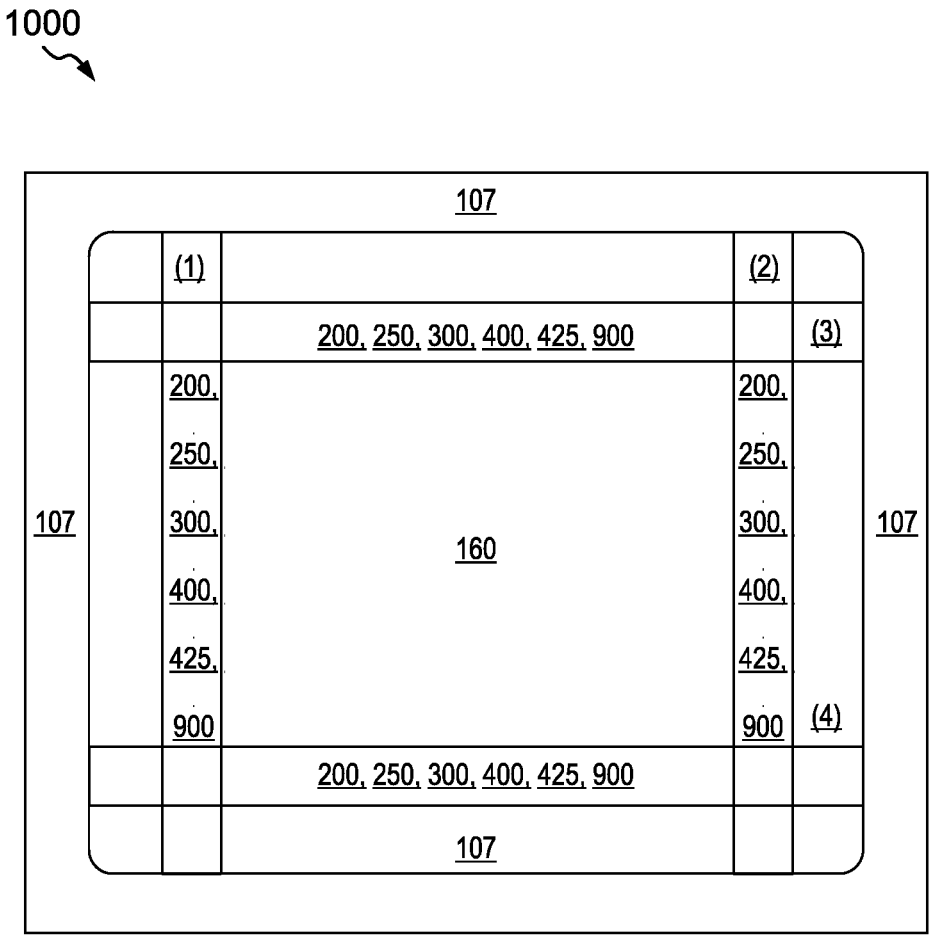
FIG. 10 illustrates several configurations in which the modular sealing apparatus can be located in a vacuum chamber of the vacuum packaging machine, in accordance with several respective embodiments of the present disclosure.

FIG. 10 illustrates several configurations 1000 in which the modular scaling apparatus 200, 250, 300, 400, 425, or 900 can be located in the vacuum chamber 106 of the vacuum packaging machine 100, in accordance with several respective embodiments of the present disclosure. The different locations of the modular scaling apparatus 200, 250, 300, 400, 425, or 900 have been numbered as (1), (2), (3), and (4) parallel to the internal walls 107. One unit of the modular sealing apparatus 200, 250, 300, 400, 425, or 900 can be installed at any one of the four locations (1), (2), (3), and (4). Furthermore, two units of the modular scaling apparatus 200, 250, 300, 400, 425, or 900 can be installed in parallel configurations, for example (1) and (2), or (3) and (4). For the modular sealing apparatus 425 having the interface module 402 at the rear side of the actuation box 204, with relatively smaller overall widths, there are several more combinations possible including two units, three units, and all four units. For example, combinations of two units can include (1) and (2); (1) and (3); (1) and (4); (2) and (3); (2) and (4); and (3) and (4). Combinations of three units can include (1), (2), and (3); (1), (2), and (4); (1), (3), and (4); and (2), (3), and (4). Also, a combination of all four units would include (1), (2), (3), and (4). A person skilled in the art would appreciate that in all possible combinations, equal numbers of counterpart 108 would need to be installed with the lid 104, directly above the cap module(s) 202.

The modular scaling apparatus 200, 250, 300, 400, 425, or 900 allows the vacuum chamber machine 100 to be operated by both conventional open-loop control methodology and a dynamic sensor-based closed-loop control methodology. The discussion below provides two example implementations of the modular sealing apparatus 200, 250, 300, 400, 425, or 900. A first example implementation discusses the open loop control methodology using the modular sealing apparatus 200, 250, 300, 400, 425, or 900. A second example implementation discusses the sensor-based dynamic closed-loop control methodology which is not supported by the current state-of-the-art vacuum chamber machines.

Figure 11A:
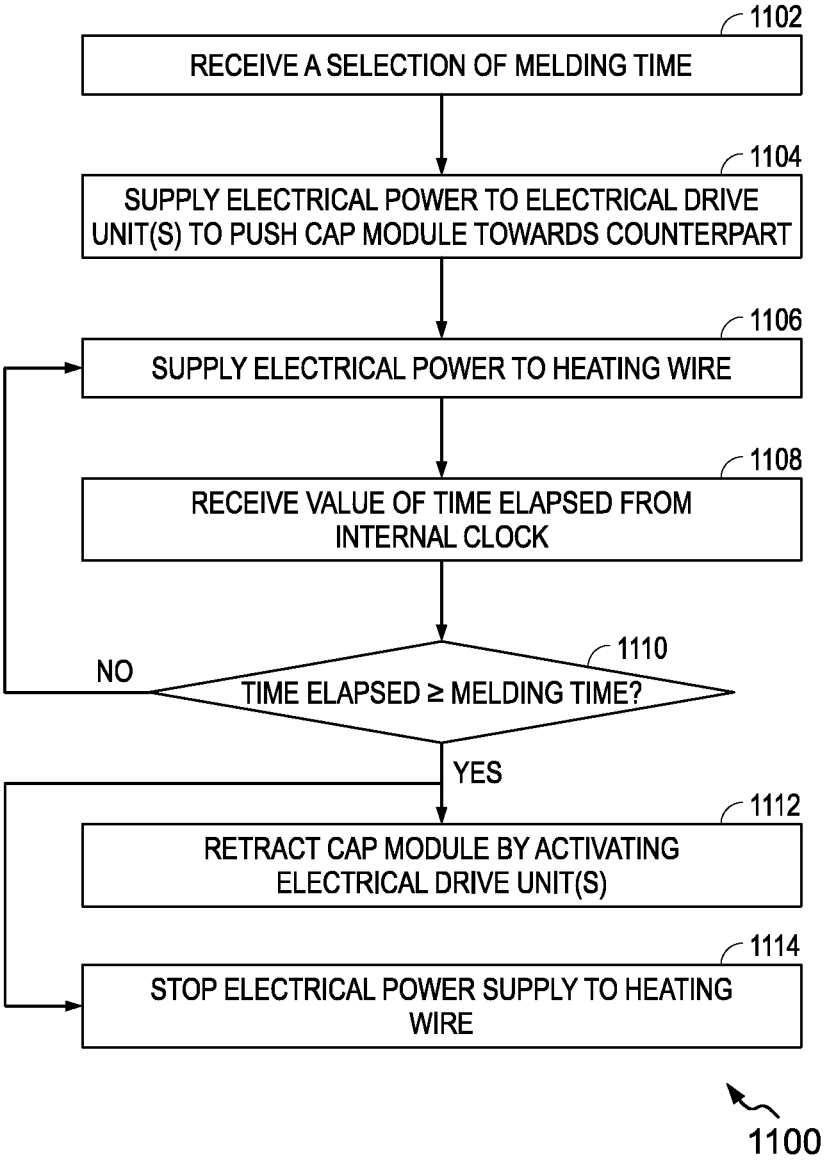
FIG. 11A illustrates a method of operating a vacuum chamber machine with a modular sealing apparatus installed therein, using an open loop control strategy, in accordance with an embodiment of the present disclosure.

FIG. 11A illustrates a method 1100 of operating the vacuum chamber machine 100 with the modular scaling apparatus 200, 250, 300, 400, 425, or 900 installed therein, using an open loop control strategy, in accordance with an embodiment of the present disclosure. The method steps of the method 1100 may be carried out by the machine control architecture 802 or the controller 902 as applicable. The method 1100 begins at Step 1102, when a selection of melding time is received as a user input, by the machine control architecture 802 or the controller 902. The packet 112 is located onto the cap module 202 for melding.

At Step 1104, the electrical power is supplied to the electrical drive unit(s) 208 to push the cap module 202 towards the counterpart 108. For example, the electrical power may be supplied to the actuator(s) 209 to activate the actuation member(s) 110 to push the cap module 202 towards the counterpart 108.

At Step 1106, the electrical power is supplied to the heating wire 232 causing the melding of the packet 112 to be initiated.

At Step 1108, a value of time elapsed is received from an internal clock of the machine control architecture 802 or the controller 902.

At Step 1110, it is confirmed if the time elapsed is greater than or equal to the melding time received as the user input. When the time elapsed is smaller than the melding time the method 1100 returns to Step 1106. However, when the time elapsed is greater than the melding time, the method 1100 moves to Step 1112 and Step 1114.

At Step 1112, the cap module 202 is retracted by activating the electrical drive unit(s) 208. For example, the actuation member(s) 210 are activated by supplying the electrical power to the actuator(s) 209 of the electrical drive unit(s) 208. Also, at Step 1114, the electrical power supply to the heating wire 232 is stopped.

Figure 11B:
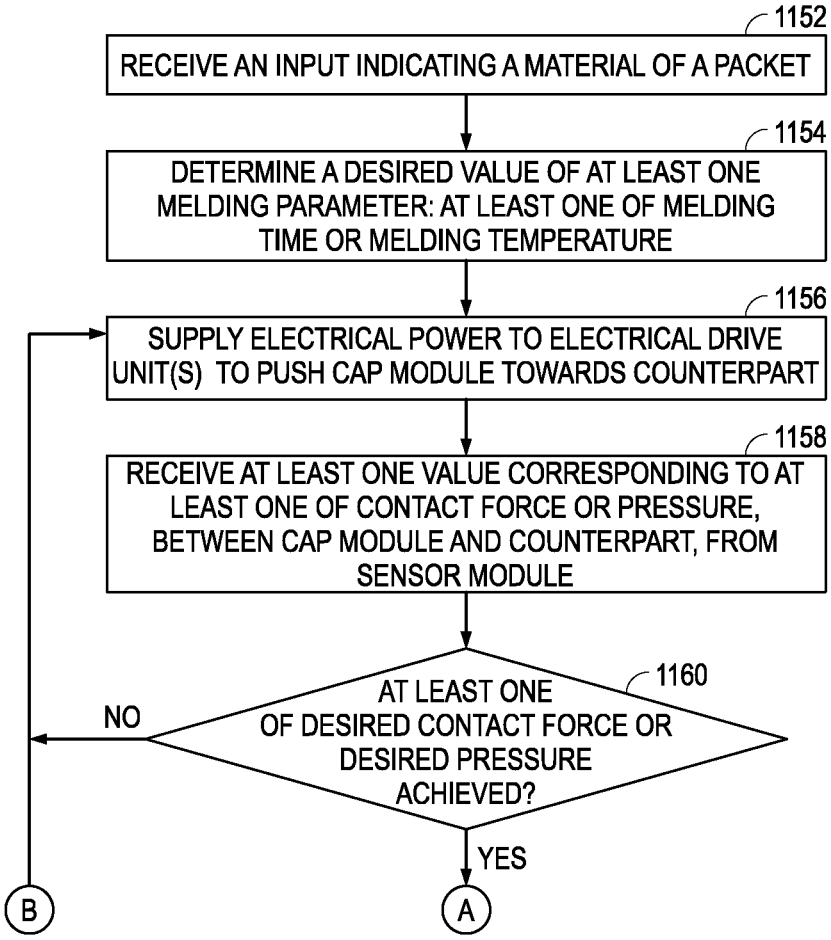
FIG. 11B illustrates a method of operating a vacuum chamber machine with a modular sealing apparatus installed therein, using a dynamic closed-loop control strategy, in accordance with an embodiment of the present disclosure.
Figure 11B:
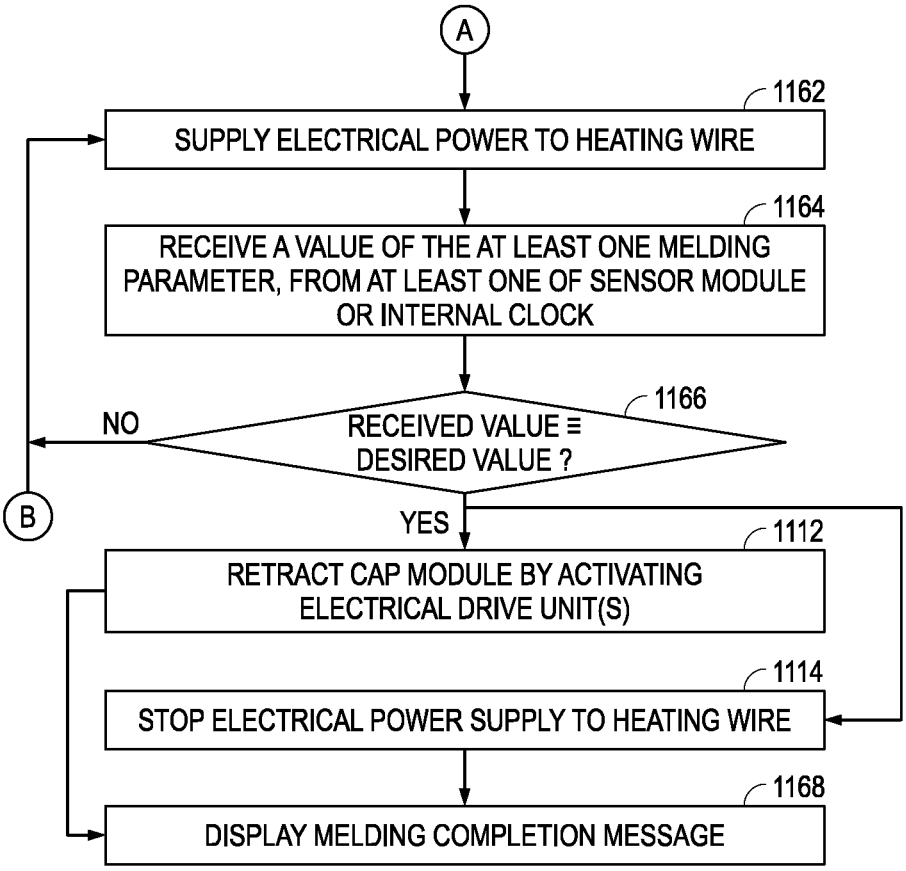
Figure 11B:
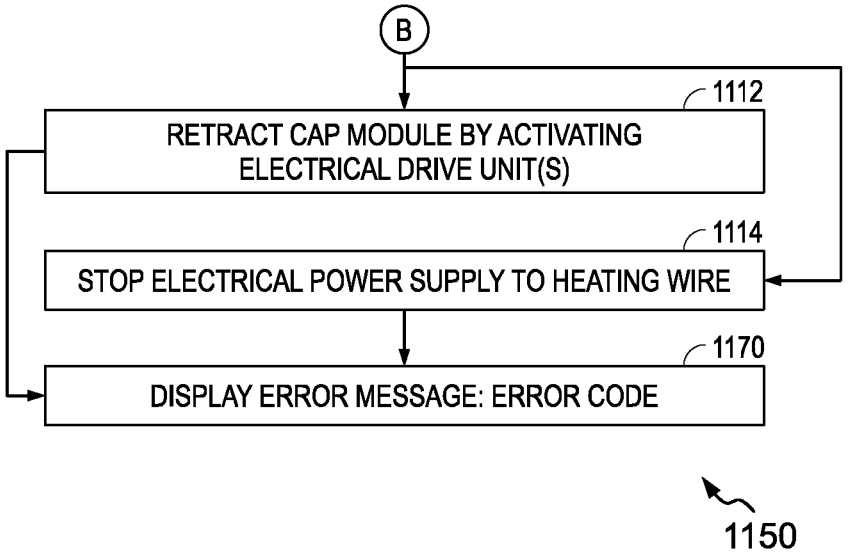

FIG. 11B illustrates a method 1150 of operating the vacuum chamber machine 100 with the modular sealing apparatus 200, 250, 300, 400, 425, or 900 installed therein, using a dynamic closed-loop control strategy, in accordance with an embodiment of the present disclosure. The method steps of the method 1150 may be carried out by the machine control architecture 802 or the controller 902 as applicable. The method 1150 begins at Step 1152 when an input indicating a material of the packet 112 is received from a user. The input may be in the form of an abbreviation, a number code, an alphanumeric code, etc.

At Step 1154, the machine control architecture 802 or the controller 902, as applicable, determines a desired value of at least one melding parameter based on the material of the packet 112. For example, the at least one melding parameter may be selected from a group consisting of a melding time, and a melding temperature in the melding zone.

At Step 1156, like Step 1104, the electrical power is supplied to the electrical drive unit(s) 208 to push the cap module 202 towards the counterpart 108. For example, the electrical power may be supplied to the actuator(s) 209 to activate the actuation member(s) 110 to push the cap module 202 towards the counterpart 108.

At Step 1158, at least one value corresponding to at least one of a contact force or a pressure between the cap module 202 and the counterpart 108 is received from the sensor module 601.

At Step 1160, it is confirmed that at least one of a desired contact force or a desired pressure has been achieved. When the at least one of the desired contact force or the desired pressure has been achieved, the method 1150 moves to Step 1162. Otherwise, the method 1150 returns to Step 1156. However, when after a predetermined critical number of attempts or a predetermined critical amount of time, the at least one of the desired contact force or the desired pressure has still not been achieved, the method 1150 moves to Step 1112 and Step 114, followed by Step 1170, where an error message is displayed to the user. The error message may also include an error code indicative of the nature of the malfunction.

At Step 1162, like Step 1106, the electrical power is supplied to the heating wire 232 causing the melding of the packet 112 to be initiated.

At Step 1164, a value of the at least one melding parameter is received. For example, at least one of a value of a time elapsed is received from the internal clock or a value of the temperature in the melding zone is received from the sensor module 601.

At Step 1166, if the received value of the at least one melding parameter is identical or equivalent to the determined desired value of the at least one melding parameter, the method 1150 moves to Step 1112 and 114, followed by Step 1168 where a melding completion message is displayed to the user. For example, when the value of the time elapsed is identical or equivalent to the desired melding time or when the value of the temperature in the melding zone is identical or equivalent to the desired melding temperature, the method 1150 moves to Step 1112 and 1114, followed by Step 1168. Otherwise, the method 1150 returns to Step 1162. However, when after a predetermined critical number of attempts or a predetermined critical amount of time, the determined desired value of the at least one melding parameter has still not been attained, the method 1150 moves to Step 1112 and Step 114, followed by Step 1170, where an error message is displayed to the user. The error message may also include an error code indicative of the nature of the malfunction.

Embodiments of the modular sealing apparatus as presented above offer several advantages. For instance, the modular sealing apparatus has defined interfaces that allow the modular sealing apparatus to fit with a wide range of existing vacuum packaging machine models from a variety of manufacturers. The modular design allows for easy, fast, no-tool removal and lower-cost replacements of components of the modular sealing apparatus. Furthermore, the modular sealing apparatus as presented above can be used by anyone without requiring extensive training or soliciting the help of an operator specifically trained for operating vacuum packaging machines and related accessories. In addition, the use of sleeves and sealing elements such as sealing rings prevent the ingress of foreign matter into the modular sealing apparatus. The core components can be standardized for the flexibility of interfacing with different chamber design variants. The modular scaling apparatus enables a seamless or flush vacuum chamber surface enabling a hygienic design. The modular sealing apparatus eliminates expensive maintenance issues by replacing membrane components and preventing leakage of liquid contents of packets or bags being sealed.

Furthermore, the temperature of the heating wire and melding time are controlled directly, independently, and within accepted tolerances. The operator does not have to worry about inconsistencies between various settings. In common cases of inconsistent electrical supply on the respective circuit, the modular sealing apparatus helps also to eliminate those inconsistencies by directly controlling the temperature of the heating wire. In addition, the remaining critical parameter, i.e., the at least one of the contact force or the pressure between the cap module and the counterpart, is also provided consistently. The sensor module, the pressure/force sensor feedback, and the independent control of actuators allow the decoupling of the contact force/pressure between the cap module and the counterpart, from the vacuum in the vacuum chamber. Furthermore, the closed-loop control enabled due to the sensor module enables predictive maintenance and segment control of pressure and temperature in the melding zone. Controlling the temperature in the melding zone has several advantages. As in the current state of the art, the heating bars (such as the heating bar 110) may get excessively warm affecting the quality of the melding process over some time.

Various embodiments of the disclosure, as discussed above, may be practiced with steps and/or operations in a different order, and/or with hardware elements in configurations, which are different than those which, are disclosed. Therefore, although the disclosure has been described based on these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A modular sealing apparatus for a vacuum packaging machine, comprising:

a cap module comprising a central portion, wherein the central portion locates thereupon a heating wire, the heating wire is connected to an electrical power unit and is configured to heat up when supplied with electrical power through the electrical power unit;

an actuation box, the cap module detachably coupled to the actuation box, wherein the actuation box is located below the cap module, the actuation box comprising an electrical drive unit, wherein, in use, the electrical drive unit is configured to cause the cap module to move upwards and against a counterpart attached to the vacuum packaging machine, by activating an actuation member of the electrical drive unit;

an interface module coupled to the actuation box, the interface module configured to detachably fasten the actuation box to the vacuum packaging machine, and enable supply of the electrical power to the actuation box from the vacuum packaging machine; and a sensor module comprising one or more sensors configured to sense at least one temperature value in an upper portion of the cap module, wherein the electrical power unit is configured to be supplied with the electrical power, from the actuation box, through a first contact member, and wherein the first contact member is encapsulated by a first upper sleeve and a first lower sleeve, one of the first upper sleeve and the first lower sleeve sockets the other, a first sealing ring is provided between the first upper sleeve and the first lower sleeve.

2. The modular sealing apparatus as claimed in claim 1, further comprising a protective film configured to cover the heating wire.

3. The modular sealing apparatus as claimed in claim 1, wherein the cap module further comprises at least one end connection portion provided on at least one respective end of the central portion, wherein the at least one end connection portion is configured to fasten the heating wire to the central portion.

4. The modular sealing apparatus as claimed in claim 1, wherein the electrical power unit comprises a conductor spring strip comprising a deformable portion, the conductor spring strip configured to be in contact with the first contact member and supply electrical power to the heating wire through a contact port when the modular sealing apparatus is in use.

5. The modular sealing apparatus as claimed in claim 4, further comprising a predetermined gap provided between the contact port and an open end of the conductor spring strip, wherein the open end of the conductor spring strip is configured to traverse the predetermined gap in response to a predetermined pressure exerted by the cap module onto the counterpart.

6. The modular sealing apparatus as claimed in claim 1, further comprising at least one data connection connecting the sensor module and the actuation box, wherein the at least one data connection is configured to transmit sensor data from the sensor module to the actuation box.

7. The modular sealing apparatus as claimed in claim 1, wherein the one or more sensors are further configured to sense at least one of a contact force or a pressure between the cap module and the counterpart.

8. The modular sealing apparatus as claimed in claim 1, wherein the sensor module is configured to be supplied with the electrical power, from the actuation box, through at least one of the first contact member or a second contact member.

9. The modular sealing apparatus as claimed in claim 8, wherein the second contact member is encapsulated by a second upper sleeve and a second lower sleeve, one of the second upper sleeve and the second lower sleeve sockets the other, a second sealing ring is provided between the second upper sleeve and the second lower sleeve.

10. The modular sealing apparatus as claimed in claim 1, wherein the counterpart comprises one or more counterpart sensors connected to the sensor module, the one or more counterpart sensors configured to sense at least one temperature value in a lower portion of the counterpart.

11. The modular sealing apparatus as claimed in claim 10, wherein the one or more counterpart sensors are further configured to sense at least one of a contact force or a pressure between the cap module and the counterpart.

12. The modular sealing apparatus as claimed in claim 1, wherein the electrical drive unit further comprises an actuator selected from a group consisting of a linear actuator, a rotary actuator coupled to a transmission configured to convert the rotary motion of the rotary actuator into a linear motion of at least the actuation member, a Shape-Memory-Alloy (SMA), a thermal actuator, and combinations thereof.

13. The modular sealing apparatus as claimed in claim 1, wherein, in use, the actuation box and the counterpart are configured to remain stationary and the cap module is configured to move upwards and downwards relative to the actuation box and the counterpart, by activating the actuation member removably fastened to the cap module, and wherein the cap module further comprises at least one support cavity in a lower portion of the cap module, the at least one support cavity configured to receive therewithin the actuation member.

14. The modular sealing apparatus as claimed in claim 1, wherein, in use, the counterpart is configured to be stationary, and the actuation box and the cap module are configured to together move upwards and downwards relative to the counterpart, by activating the actuation member in contact with a floor of a vacuum chamber of the vacuum packaging machine, and wherein the cap module further comprises at least one support cavity in a lower portion of the cap module, the at least one support cavity configured to receive therewithin at least one upper support member.

15. The modular sealing apparatus as claimed in claim 1, wherein a portion of the actuation member protruding outside the actuation box is encapsulated by an actuation member sleeve and an actuation member sealing ring.

16. The modular sealing apparatus as claimed in claim 1, further comprising an installation box comprising a plurality of first terminal pins for at least one of an electrical power connection or a data connection with a plurality of respective second terminal pins of the actuation box, wherein the installation box is configured to be detachably fastened to an external wall of a vacuum chamber of the vacuum packaging machine, wherein the interface module comprises a plurality of double-sided receptacles configured to:

receive therewithin, the plurality of first terminal pins and the plurality of respective second terminal pins, and enable electrical conduction between the plurality of first terminal pins and the plurality of respective second terminal pins.

17. The modular sealing apparatus as claimed in claim 16, wherein the installation box is configured to be detachably fastened to the internal wall through one or more magnets.

18. The modular sealing apparatus as claimed in claim 16, wherein the plurality of first terminal pins and the plurality of respective second terminal pins are configured to be received within the plurality of double-sided receptacles without use of additional assembly tools, the additional assembly tools comprising manual drivers, manual spanners, electrically powered wrenches and drivers, and pneumatically powered wrenches and drivers.

19. The modular sealing apparatus as claimed in claim 1, wherein the cap module comprises the central portion wherein a upper surface of at least the central portion is bent upwards forming an upward convex geometry, the heating wire conforming with the upward convex geometry of the central portion.

20. The modular sealing apparatus as claimed in claim 19, wherein at least the central portion is made from a deformable material, and the actuation box comprises two or more electrical drive units and two or more respective actuation members, wherein, in use, the two or more electrical drive units are configured to be provided with disparate amounts of electrical power resulting in disparate magnitudes of linear motion of the two or more respective actuation members, wherein combined with the ability of the modified central portion to be deformable, the two or more actuation members are configured to modify a geometry of the cap module to achieve disparate predetermined geometries of space between the counterpart and the cap module, in conformance with disparate respective predetermined geometries of disparate respective packets to be sealed.

21. The modular sealing apparatus as claimed in claim 1, wherein the actuation box further comprises a controller, the controller is configured to control one or more of an activation of the actuation member, a temperature in a melding zone, and a time period of the melding process.

22. The modular sealing apparatus as claimed in claim 1, wherein the interface module comprises at least one dock configured to be fastened to at least one respective internal wall of a vacuum chamber of the vacuum packaging machine, and at least one channel configured to receive therein at least one respective protrusion provided with the actuation box, to detachably couple the actuation box to the interface module.

23. The modular sealing apparatus as claimed in claim 1, further comprising at least one actuation box shoe provided in a lower portion of the actuation box and at least one interface module shoe provided in a lower portion of the interface module, wherein one or both of the at least one actuation box shoe and the at least one interface module shoe comprises a quick-release fastening arrangement to removably fasten the actuation box and the interface module, respectively, to a floor of a vacuum chamber of the vacuum packaging machine.

24. A vacuum packaging machine comprising a vacuum chamber defined by a lid member and a cavity in a lower compartment, at least one modular sealing apparatus detachably coupled to at least one internal wall of the vacuum chamber, the at least one modular sealing apparatus comprising:

a cap module comprising a central portion, wherein the central portion locates thereupon a heating wire, the heating wire is connected to an electrical power unit and is configured to heat up when supplied with electrical power through the electrical power unit;

an actuation box, the cap module detachably coupled to the actuation box, wherein the actuation box is located below the cap module, the actuation box comprising an electrical drive unit, wherein, in use, the electrical drive unit is configured to cause the cap module to move upwards and against a counterpart attached to a roof of the lid member of the vacuum packaging machine, by activating an actuation member of the electrical drive unit;

an interface module coupled to the actuation box, the interface module configured to detachably fasten the actuation box to the vacuum packaging machine, and enable supply of the electrical power to the actuation box from the vacuum packaging machine; and a sensor module comprising one or more sensors configured to sense at least one temperature value in an upper portion of the cap module, wherein the electrical power unit is configured to be supplied with the electrical power, from the actuation box, through a first contact member, and wherein the first contact member is encapsulated by a first upper sleeve and a first lower sleeve, one of the first upper sleeve and the first lower sleeve sockets the other, a first sealing ring is provided between the first upper sleeve and the first lower sleeve.

25. The vacuum packaging machine as claimed in claim 24, further comprising a plurality of counterpart protrusions provided at a bottom surface of the counterpart, wherein the plurality of counterpart protrusions is made from a deformable material and have been provided with a weak adhesive to removably attach a packet, when the vacuum packaging machine is in use.

* * * * *